US010532856B2

(12) United States Patent
O'Hara et al.

(10) Patent No.: US 10,532,856 B2
(45) Date of Patent: Jan. 14, 2020

(54) SELF-CLOSING MANUALLY RE-OPENABLE PACKAGE

(71) Applicant: Bemis Company, Inc., Neenah, WI (US)

(72) Inventors: Sarah E. O'Hara, Appleton, WI (US); Matthew R. Best, Plymouth, MN (US); Blake A. Bougie, Neenah, WI (US); Jay D. Hodson, Hortonville, WI (US)

(73) Assignee: Bemis Company, Inc., Neenah, WI (US)

( * ) Notice: Subject to any disclaimer, the term of this patent is extended or adjusted under 35 U.S.C. 154(b) by 0 days.

(21) Appl. No.: 16/066,548

(22) PCT Filed: Dec. 31, 2015

(86) PCT No.: PCT/US2015/068213
§ 371 (c)(1),
(2) Date: Jun. 27, 2018

(87) PCT Pub. No.: WO2017/116451
PCT Pub. Date: Jul. 6, 2017

(65) Prior Publication Data

US 2019/0023456 A1 Jan. 24, 2019

(51) Int. Cl.

| | |
|---|---|
| ***B65D 33/30*** | (2006.01) |
| ***B65D 33/14*** | (2006.01) |
| ***B65D 75/58*** | (2006.01) |

(52) U.S. Cl.
CPC ..... *B65D 33/30* (2013.01); *B65D 33/14* (2013.01); *B65D 75/5805* (2013.01)

(58) Field of Classification Search
CPC ..... B65D 33/30; B65D 33/14; B65D 75/5805
USPC ..... 383/43, 35, 65
See application file for complete search history.

(56) References Cited

U.S. PATENT DOCUMENTS

| | | | | |
|---|---|---|---|---|
| 670,029 A | | 3/1901 | Meier et al. | |
| 705,455 A | | 7/1902 | Siegel et al. | |
| 1,798,945 A | | 3/1931 | Alfred et al. | |
| 2,232,888 A | * | 2/1941 | Schimelmitz | A45C 1/06 383/107 |

(Continued)

FOREIGN PATENT DOCUMENTS

| | | |
|---|---|---|
| CA | 2663481 A1 | 10/2009 |
| CN | 102844244 A | 12/2012 |

(Continued)

OTHER PUBLICATIONS

"Films, Orientation", Encyclopedia of Polymer Science and Technology, 3rd Ed., vol. 2, pp. 559-577, 2003, John Wiley & Sons, Hoboken, NJ, USA.

*Primary Examiner* — Jes F Pascua
(74) *Attorney, Agent, or Firm* — Amy L. De Coster

(57) ABSTRACT

A package which may be opened and closed using only one hand, without the need for any tools or a second hand subsequent to initial opening, is provided as a hand-held sized, flexible thermoplastic bag having a self-closing, manually openable closure employing at least two resilient stays, each of which is covered at least in part by a cover film which may be a non-shrink film or a heat shrinkable film. The stays and cover films form in conjunction with the package body opposing rolled edges or package wall ridges that facilitate opening and create a close-fitting interior closure surface along the abutting cover films.

19 Claims, 7 Drawing Sheets

(56) References Cited

U.S. PATENT DOCUMENTS

| | | | | |
|---|---|---|---|---|
| 2,823,723 | A | | 2/1958 | Cohn |
| 3,022,543 | A | | 2/1962 | Baird et al. |
| 3,272,248 | A | | 9/1966 | O'Farrell et al. |
| 3,456,044 | A | | 7/1969 | Pahlke et al. |
| 3,635,376 | A | | 1/1972 | Hellstrom et al. |
| 3,696,917 | A | | 10/1972 | Levi et al. |
| 3,709,426 | A | * | 1/1973 | Farkas ..... B65D 33/30 383/49 |
| 3,782,601 | A | | 1/1974 | Krawagna |
| 4,153,091 | A | | 5/1979 | Jahn |
| 4,277,594 | A | | 7/1981 | Matthews et al. |
| 4,317,478 | A | | 3/1982 | Babbidge |
| 4,593,408 | A | | 6/1986 | Drobish et al. |
| 4,598,826 | A | | 7/1986 | Shinbach |
| 4,756,628 | A | | 7/1988 | Branson |
| 4,796,300 | A | * | 1/1989 | Branson ..... B29C 37/0082 24/462 |
| 4,898,477 | A | | 2/1990 | Cox et al. |
| 4,907,694 | A | | 3/1990 | Miller et al. |
| 5,037,138 | A | | 8/1991 | McClintock et al. |
| 5,076,977 | A | | 12/1991 | Maier et al. |
| 5,174,658 | A | | 12/1992 | Cook et al. |
| 5,561,966 | A | | 10/1996 | English |
| 5,609,419 | A | | 3/1997 | Byers, Jr. |
| 5,941,641 | A | | 8/1999 | Kinigakis et al. |
| 6,354,459 | B1 | | 3/2002 | Hagihara |
| 6,702,794 | B2 | | 3/2004 | Blum et al. |
| 7,577,384 | B2 | | 8/2009 | Durham et al. |
| 8,272,107 | B2 | | 9/2012 | Turvey et al. |
| 8,485,728 | B2 | | 7/2013 | Bowers et al. |
| 8,920,030 | B2 | | 12/2014 | McSweeney et al. |
| 2001/0026650 | A1 | | 10/2001 | Denko |
| 2001/0037627 | A1 | | 11/2001 | Hausslein |
| 2005/0006399 | A1 | | 1/2005 | Faulks et al. |
| 2005/0035150 | A1 | | 2/2005 | Laverdure |
| 2006/0140514 | A1 | | 6/2006 | Dierl et al. |
| 2008/0307614 | A1 | | 12/2008 | Dais et al. |
| 2009/0266036 | A1 | | 10/2009 | Zerfas et al. |
| 2009/0269450 | A1 | | 10/2009 | Zerfas et al. |
| 2009/0304875 | A1 | | 12/2009 | Zerfas et al. |
| 2010/0278457 | A1 | | 11/2010 | Greco et al. |
| 2012/0141048 | A1 | | 6/2012 | Ribi |
| 2012/0170873 | A1 | | 7/2012 | Mathews |
| 2012/0230613 | A1 | | 9/2012 | Galland et al. |

FOREIGN PATENT DOCUMENTS

| | | | |
|---|---|---|---|
| CN | 102858647 | A1 | 1/2013 |
| EP | 1783059 | A1 | 9/2007 |
| FR | 1209370 | A | 3/1960 |
| GB | 685379 | A | 1/1953 |
| GB | 2311275 | A | 9/1997 |
| GB | 2393112 | A | 3/2004 |
| JP | 54131475 | A | 10/1979 |
| JP | 5178366 | A | 7/1993 |
| JP | 2002128093 | A | 5/2002 |
| JP | 2003072779 | A | 3/2003 |
| JP | 2003170946 | A | 6/2003 |
| JP | 2009124956 | A | 6/2009 |
| JP | 2009263008 | A | 11/2009 |
| MX | 2010004522 | A | 10/2010 |
| WO | 1993015969 | A1 | 8/1993 |
| WO | 2007143205 | A2 | 12/2007 |

* cited by examiner

SELF-CLOSING MANUALLY RE-OPENABLE PACKAGE

This application relates generally to self-closing, hand-held packaging suitable for packaging products including small food or non-food items such as edible nuts, seeds, convections, candles, chocolates, mints, cough drops, snacks, pet treats, birdseed, paper dips, tacks, fasteners, jewelry beads, BB shot, etc.

BACKGROUND OF THE INVENTION

Hand-held packaging for, for example, pourable solid products is commercially available in many styles and sizes, e.g., 0.5-4 ounce boxes, bags, cans, pouches or tubes made of paper, plastic or metal for a range of food items, such as tree nuts, sunflower seeds, pumpkin seeds, caramel corn, peanuts, hard shell chocolates, breath mints, and non-food items, such as paper dips, screws, jewelry beads, etc. Both food and non-food containing hand-held packages are available in a wide variety of sizes and shapes. For example, metal cans made from aluminum, steel and other materials are well-known. Plastic and glass jars, bottles and tubs as well as plastic and paper bags including pouches, envelopes, stick packages, etc. are all ubiquitous in modern commerce. Suitable packaging, e.g., for pourable or flowable articles which comprise a multitude of small solid products ranging from items such as cinnamon candies to BB shot, is designed to contain the product within the package while protecting the product from contamination and deleterious effects from the external environment. Containers may protect their contents from contact or exposure to unwanted materials such as dirt, dust, microbes, insects, air, moisture, sunlight, etc. Also, the materials used in constructing packaging and especially the product contact interior surface layer thereof (e.g., for packaging a product such as a food, nutritional supplement, or drug), should resist migration of chemicals between the product and the package materials. These materials should also resist destruction, e.g., by perforation from the product intended to be packaged.

A variety of closures have been employed or described in the prior art for such packaging, including closures adapted for reclosing, such as zippers, slider zippers, hook and loop type fasteners, and peel reseal closures made. e.g., with pressure sensitive adhesive (PSA). Some closures in the prior art have self-closing features, such as coin purses and certain flexible packaging.

Examples of prior art packaging having zippers, peel reseal closures and other common features include U.S. Pat. No. 5,561,966; U.S. Patent Publication (USPP) No. 2010/0278457 and European Patent Publication No. 1 783 059.

Examples of prior art packaging having openings which are both re-closable and re-openable include U.S. Pat. Nos. 1,798,945; 3,782,601; 3,635,376; 4,907,694; 4,593,408; and 5,037,138; and USPP No. 2005/0035150.

Packages designed for one-handed opening are also known, e.g., U.S. Pat. No. 5,609,419 and USPP No. 2012/0141048.

Packages designed for self-closing devices for flexible pouches are also known, e.g., U.S. Pat. No. 8,485,728; USPP Nos. 2009/0266036, 2009/0269450, 2009/0304875 and 2012/0230613; and France Patent Document No. 1,209,370. The closures in these packages are often circular bands or stays which are arcuate or have convex or concave shapes in cross-section either from top to bottom or along the length of a resilient stay.

As previously noted, a variety of self-closing packages are well known in the art. These packages often employ a pair of spring-like devices variously termed stays, profile members, resilient strips or springs. These spring-like devices often require a pulling force, such as two hands, to grasp opposing package sides to pull apart to open. In some teachings, the spring-like devices utilize indentations, scores, or other thickness variations to provide directionality to resilient deformation forces to facilitate opening and avoid paired deformation in the same direction (termed "same direction bowing") which defeats opening, (see, e.g., U.S. Pat. No. 3,272,278 (indentations or scores); and U.S. Pat. No. 4,317,478 (bent or creased points)).

Thus, many commercially available food products, e.g., gum, hard shell chocolate candles, mints, nuts, seeds, etc., are packed in packages which are initially opened without any means for re-closing and re-opening or which require the use of two hands to do so or which do not self-close allowing spillage if the package is dropped in an open state.

Disadvantageously, most prior art packaging designed for re-opening and re-closing multiple times (following initial opening) are impossible or very difficult to re-open with a single hand unaided by external mechanical devices. In addition, the problems of (1) inconsistent opening or same direction bowing and (2) ensuring sufficient closure to prevent spilling of contents are areas where improvements are desirable.

BRIEF SUMMARY OF THE INVENTION

The package described in the present application permits one-handed opening and closing of the package after initial opening. This advantage is not only a convenient feature for all persons but may be particularly desirable for people who have diminished use or loss of one hand. In use, the package subsequent to initial opening may be re-opened using only one hand without the need for any tools or a second hand and may be automatically closed merely by releasing the hand pressure needed to maintain an open configuration.

The package is a hand-held sized, flexible thermoplastic bag (having, as a non-limiting example, a capacity ≤500 $cm^3$) having an automatically self-closing, manually openable closure employing at least two resilient stays, each of which is covered at least in part by a cover film which may be a non-shrink film or a heat shrinkable film. These stays and cover films form, in conjunction with the package body, opposing rolled edges or package wall ridges that facilitate opening and also create an interior closure surface along abutting cover films.

The package is suitable for packaging, e.g., small pourable solid articles or products of a size typical for consumer or individual use. Examples of products which may be packaged in accordance with the package described in the present application include, without limitation, foods or food ingredients, such as seeds, nuts, mints, or gum pieces; drugs or physiologically active substances such as aspirin pills or vitamins; and non-food items, such as fasteners, small precision electronic components, decorative beads, etc.

DETAILED DESCRIPTION OF THE INVENTION

Figure 1:
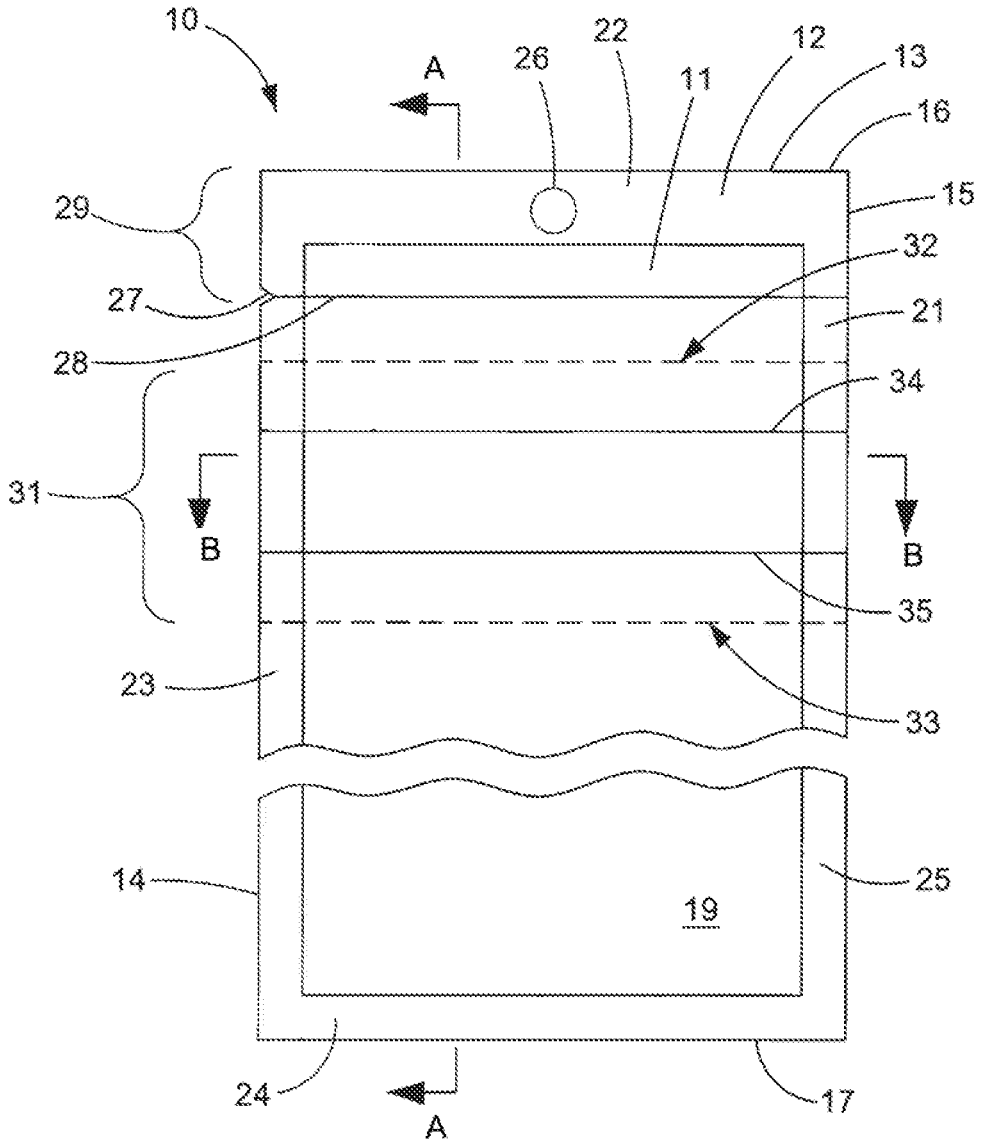
FIG. 1 is a front schematic view, with a cut away portion, of a package in accordance with the present application.

As used throughout this application, "hand-held" or "handheld" packaging is sized for manual opening typically utilizing one hand to squeeze open the closure. Such handheld packaging has a lay-flat transverse dimension that may be sized to fit between a thumb and opposing finger of the same hand. In some embodiments, this transverse dimension is less than 5 inches or less than 4 inches or between 2 to 4 inches.

As described in the present application, the handheld package capacity may vary in accordance with the ability of the chosen design parameters to retain the particular goods to be packaged, e.g., in typical consumer use for snack foods such as jelly beans or edible nuts, etc. or for non-food items such as jewelry beads or small fasteners. In some embodiments, the handheld package has a capacity less than 500 $cm^3$ or less than 350 $cm^3$ and/or a weight less than 500 grams or less than 300 grams or less than 100 grams.

In discussing polymers, plastic films and packaging, various acronyms are used throughout this application and they are listed below. Also, in referring to blends of polymers a colon (:) is used to indicate that the components to the left and right of the colon are blended. In referring to a packaging wall, film or stay structure, a slash "/" is used to indicate that components to the left and right of the slash are in different layers and the relative position of components in layers may be so indicated by use of the slash to indicate layer boundaries. Acronyms and terms commonly employed throughout this application include the following:

PET—polyethylene terephthalate

APET—amorphous polyethylene terephthalate

OPET—oriented polyethylene terephthalate

PETG—glycolized polyethylene terephthalate

COC—a cyclic olefin copolymer such as ethylene norbornene copolymer

PE—polyethylene (including. e.g., ethylene homopolymer and/or copolymer of a major portion of ethylene with one or more α-olefins)

LDPE—low density polyethylene

LLDPE—linear low density polyethylene mLLDPE—metallocene catalyzed linear low density polyethylene $C_2$— ethylene monomer $C_4$— butene-1 monomer $C_6$—hexene-1 monomer $C_8$— octene-1 monomer $C_{10}$— decene-1 monomer $C_2C_x$— a substantially linear copolymer of ethylene and an α-olefin where "x" indicates the number of carbon atoms in the comonomer.

EAO—ethylene α-olefin copolymer

VA—vinyl Acetate

EVA—copolymer of ethylene with vinyl acetate

EVOH—a saponified or hydrolyzed copolymer of ethylene and vinyl acetate

EAA—copolymer of ethylene with acrylic acid

EMA—ethylene methacrylic acid copolymer ionomer—an ethylene-methacrylate acid copolymer whose acid groups have been neutralized partly or completely to form a salt, such as a zinc or sodium salt PA—polyamide PP—polypropylene PVC—polyvinyl chloride (including, e.g., copolymers that contain at least 50% vinyl chloride)

As used throughout this application, the term "adhesive layer" or "tie layer" refers to a layer or material placed on one or more layers to promote the adhesion of that layer to another surface. Adhesive layers may be positioned between two layers of a multilayer structure to maintain the two layers in position relative to each other and prevent undesirable delamination. Unless otherwise indicated, an adhesive layer may have any suitable composition that provides a desired level of adhesion with the one or more surfaces in contact with the adhesive layer material. Optionally, an adhesive layer placed between a first layer and a second layer in a multilayer film may comprise components of both the first layer and the second layer to promote simultaneous adhesion of the adhesive layer to both the first layer and the second layer to opposite sides of the adhesive layer.

As used throughout this application, unless otherwise indicated, the phrases "seal layer," "sealing layer," "heat seal layer," "heat sealing layer" and "sealant layer," refer to a packaging wall, film or stay layer, or layers, involved in the sealing of the wall, film, or stay. In general, the sealant layer is a surface layer, i.e., an exterior or an interior layer, of any suitable thickness, that provides for sealing to itself or another layer or article. The interior surface seal layer frequently may also serve as an article contact layer in the packaging of articles.

As used throughout this application, the terms "heat seal layer," "heat sealing layer" or "heat sealant layer" are used interchangeably to refer to a layer which is heat sealable, i.e., capable of fusion bonding by conventional indirect heating means which generate sufficient heat on at least one contact surface for conduction to the contiguous contact surface and formation of a bond interface therebetween without loss of integrity. The bond interface between contiguous inner layers preferably has sufficient physical strength to withstand the packaging process and subsequent handling. Advantageously, the bond interface is preferably sufficiently thermally stable to prevent gas or liquid leakage therethrough when exposed to above or below ambient temperatures, e.g., during packaging operations, storage, handling, and/or transport. Heat seals may be designed to meet different conditions of expected use, and various heat seal formulations are known in the art and may be employed with the package described in the present application. The article contact or heat seal layer may be heat sealable to itself or to other objects, films or layers.

"Polyolefin" is used throughout this application to include polymers such as polyethylene, ethylene-alpha olefin copolymers, polypropylene, polybutene, ethylene copolymers having a majority amount by weight of ethylene polymerized with a lesser amount of a comonomer such as vinyl acetate, and other polymeric resins falling in the "olefin" family classification. Polyolefins may be made by a variety of processes well known in the art including but not limited to batch and continuous processes using single, staged or sequential reactors, slurry, solution and fluidized bed processes and one or more catalysts, including as non-limiting examples heterogeneous and homogeneous systems and Ziegler, Phillips, metallocene, single-site and constrained geometry catalysts, to produce polymers having different combinations of properties. Such polymers may be highly branched or substantially linear; and the branching, dispersity and average molecular weight may vary depending upon the parameters and processes chosen for their manufacture in accordance with the teachings of the polymer arts.

"Polyethylene" is the name for a polymer whose basic structure is characterized by the chain $—(CH_2—CH_2—)_n$. People skilled in the art generally refer to several broad categories of polymers and copolymers as "polyethylene." Placement of a particular polymer into one of these categories of "polyethylene" is frequently based upon the density of the "polyethylene" and often by additional reference to the process by which it was made, since the process often determines the degree of branching, crystallinity and density. In general, the nomenclature used is non-specific to a compound but refers instead to a range of compositions. This range often includes both homopolymers and copolymers.

For example, "high density" polyethylene (HDPE) is ordinarily used in the art to refer to both (a) homopolymers of densities from about 0.960 to about 0.970 g/cm$^3$ and (b) copolymers of ethylene and an α-olefin (e.g., 1-butene or 1-hexene) which have densities from about 0.940 to about 0.958 g/cm$^3$. HOPE includes polymers made with Ziegler or Phillips type catalysts and may also include high molecular weight "polyethylenes." In contrast to HDPE, whose polymer chain has some branching, are "ultra high molecular weight polyethylenes," which are essentially unbranched specialty polymers having a much higher molecular weight than the high molecular weight HDPE Another broad grouping of polyethylene is "high pressure, low density polyethylene" (LDPE). LDPE is used to denominate branched homopolymers having densities from about 0.915 to about 0.930 g/cm$^3$. LDPEs typically contain long branches off the main chain (often termed "backbone") with alkyl substituents of 2 to 8 carbon atoms.

Linear Low Density Polyethylene (LLDPE) are copolymers of ethylene with alpha-olefins having densities from about 0.915 g/cm$^3$ to about 0.940 g/cm$^3$. The α-olefin may be 1-butene, 1-hexene, or 1-octene. Ziegler-type catalysts may be employed. Phillips catalysts may also be used to produce LLDPE having densities at the higher end of the range, and metallocene and other types of catalysts may also be employed to produce other well-known variations of LLDPEs. An LLDPE produced with a metallocene or constrained geometry catalyst may be referred to as "mLLDPE". An example of a commercially available linear low-density polyethylene $C_2C_8$ LLDPE suitable for use includes Dowlex® 2045G having a reported density of 0.920 g/cm$^3$, a melt index of 1.0 dg/min., and a m.p. of about 122° C. which is supplied by The Dow Chemical Company of Midland, Mich., U.S.A.

Ethylene α-olefin copolymers are copolymers having an ethylene as a major component copolymerized with one or more alpha olefins such as 1-octene, 1-hexene, or 1-butene as a minor component. EAOs may include polymers known as LLDPE, VLDPE, ULDPE, and plastomers and may be made using a variety of processes and catalysts, including metallocene, single-site and constrained geometry catalysts, and Ziegler-Natta and Phillips catalysts.

Very Low Density Polyethylene (VLDPE), which may also be called "Ultra Low Density Polyethylene" (ULDPE), comprises copolymers of ethylene with α-olefins, such as 1-butene, 1-hexene or 1-octene, and are recognized by those skilled in the art as having a high degree of linearity of structure with short branching rather than the long side branches characteristic of LDPE. VLDPEs have lower densities than LLDPEs. The densities of VLDPEs are recognized by those skilled in the art to range from about 0.860 g/cm$^3$ to about 0.915 g/cm$^3$. VLDPEs having a density less than 0.900 g/cm$^3$ may be referred to as "plastomers". Exemplary of commercially available VLDPEs suitable for use include the $C_2C_8$ Attane® family of resins, e.g., Attane® NG 4701G having a reported density of 0.912 g/cm$^3$ and a melt flow index of 0.8 decigram/min., which is supplied by The Dow Chemical Company of Midland, Mich., U.S.A.

As used throughout this application, the term "polyethylene" (unless indicated otherwise) refers to ethylene homopolymers as well as copolymers of ethylene with α-olefins, and the term is used without regard to the presence or absence of substituent branch groups.

Polyethylenes may be used alone, in blends and/or with copolymers in both monolayer and multilayer films for packaging applications.

"Polypropylene" is the name for a polymer whose basic structure is characterized by the chain $(C_3H_5)_n$. Polypropylene may have several stereochemical configurations, e.g. isotactic, syndiotactic and atactic, in varying amounts. Polypropylene homopolymer may be a translucent solid at room temperature (RT) (~23° C.) with a density of from about 0.90 g/cm$^3$ to about 0.91 g/cm$^3$. The term "polypropylene" includes homopolymer as well as random and block copolymers. Copolymers of propylene may have a propylene (propene) content of 60 weight % or more, 80 weight % or more, or 90 weight % or more. Polypropylene copolymers may be copolymerized with ethylene.

As used throughout this application, the term "modified" refers to a chemical derivative, e.g., one having any form of anhydride functionality, such as anhydride of maleic acid, crotonic acid, citraconic acid, itaconic acid, fumaric acid, etc., whether grafted onto a polymer, copolymerized with a polymer, or otherwise functionally associated with one or more polymers, and is also inclusive of derivatives of such functionalities, such as acids, esters, and metal salts derived therefrom. A further non-limiting example of a common modification is acrylate-modified polyolefins.

As used throughout this applications, terms identifying polymers, such as e.g. "polyamide" or "polypropylene," are inclusive of not only polymers comprising repeating units derived from monomers known to polymerize to form a polymer of the named type but also of comonomers and unmodified and modified polymers made by, e.g., derivatization of a polymer after its polymerization to add functional groups or moieties along the polymeric chain. Furthermore, terms identifying polymers are also inclusive of "blends" of such polymers. Thus, the terms "polyamide polymer" and "nylon polymer" may refer to a polyamide-containing homopolymer, a polyamide-containing copolymer or mixtures thereof.

As used throughout this application, the term "polyamide" means a polymer having amide linkages $(—CONH—)_n$ which occur along the molecular chain and includes but is not limited to "nylon" resins.

The term "nylon" as used throughout this application refers more specifically to synthetic polyamides, either aliphatic or aromatic, either in crystalline, semi-crystalline, or amorphous form. It includes both polyamides and co-polyamides.

Thus, the terms "polyamide" or "nylon" encompass both polymers comprising repeating units derived from monomers, such as caprolactam, which polymerize to form a polyamide and copolymers derived from the copolymerization of, e.g., caprolactam with a comonomer which when polymerized alone does not result in the formation of a polyamide. Examples of polyamides include nylon homopolymers and copolymers such as nylon 6 (polycaprolactam), nylon 6,6 (poly(hexamethylene adipamide)), nylon 6,9 (poly(hexamethylene nonanediamide)), nylon 6.10 (poly(hexamethylene sebacamide)), nylon 6,12 (poly(hexamethylene dodecanediamide)), nylon 6/12 (poly(caprolactam-co-dodecanediamide)), nylon 6,6/6 (poly(hexamethylene adipamide-co-caprolactam)), nylon 66/610 (e.g., manufactured by the condensation of mixtures of nylon 66 salts and nylon 610 salts), nylon 6/69 resins (e.g., manufactured by the condensation of epsilon-caprolactam, hexamethylenediamine and azelaic acid), nylon 11 (polyundecanolactam), nylon 12 (polylauryllactam), nylon MXDI, nylon 6I/6T, and copolymers or mixtures thereof. Exemplary of commercially available polyamides suitable for use include the ULTRAMID® family of resins, e.g. ULTRAMID® B36 nylon 6 having a glass transition temperature ($T_g$) of 127° C., a density of 1.13 g/cm$^3$ and tensile strength (at yield) of 131,000 psi, and C40 nylon 6/66 having a melting point of 193° C. and a density of 1.12 g/cm$^3$, both of which may be obtained from BASF, Mount Olive, N.J., U.S.A.

As used throughout this application, "EVOH" refers to ethylene vinyl alcohol copolymer. EVOH is otherwise known as saponified or hydrolyzed ethylene vinyl acetate copolymer and refers to a vinyl alcohol copolymer having an ethylene comonomer. EVOH is prepared by the hydrolysis (or saponification) of an ethylene-vinyl acetate copolymer. The degree of hydrolysis may be from about 50 to about 100 mole percent or from about 85 to about 100 mole percent or at least about 97 mole percent. EVOH is commercially available in resin form with various percentages of ethylene, such as, for example, from about 22 mole percent to about 50 mole percent or about 29 mole percent, about 38 mole percent or about 48 mole percent. EVOH copolymers having lower or higher ethylene contents may be employed.

As used throughout this application, the term "ethylene norbornene copolymer" means an amorphous, transparent copolymer of ethylene with norbornene made by polymerization with a metallocene catalyst. It is an example of a cyclic olefin copolymer (COC).

As used throughout this application, the term "polyester" refers to synthetic homopolymers and copolymers having ester linkages between monomer units which may be formed by condensation polymerization methods. Polymers of this type may be aromatic polyesters or homopolymers or copolymers of polyethylene terephthalate, polyethylene isophthalate, polybutylene terephthalate, polyethylene naphthalate or blends thereof. Suitable aromatic polyesters may have an intrinsic viscosity from about 0.60 to about 1.0 or from about 0.60 to about 0.80. A non-limiting example of polyester is crystallized PET (CPET).

Another non-limiting example of polyester is amorphous polyethylene terephthalate (APET). APET may be formed by using an additional comonomer such as a diacid (e.g. isophthalate) or diglycol.

A further non-limiting example of polyester is glycol modified PET (PETG). PETG may be formed by using a glycol comonomer such as cyclohexane dimethanol to produce a copolymerized amorphous PET.

A still further non-limiting example of polyester is oriented PET (OPET). OPET film, sheet or articles may be manufactured by extrusion, quenching, reheating and biaxial stretching followed by annealing to produce a stable film, sheet or article.

As used throughout this application, the term "plastic" means a synthetic polymer material which at some stage of its manufacture or processing can be shaped by flow and which comprises a major proportion (>50 wt. %) of at least non-cellulosic polymer. Examples of plastics include without limitation organic thermoplastic or thermosetting polymers such as polyolefins, polyamides, polyesters, polystyrenes, polyurethanes, etc.

As used throughout this application with respect to packaging films, sheets, or planar container materials including plastic materials, the term "rigid" means a material having a Gurley stiffness of at least 1000 milligrams (mg) force in each or either of its machine direction (MD) and/or transverse direction (TD). A standard test method for determining the rigidity, stiffness values described herein is a Gurley Stiffness test, a description of which is set forth in TAPPI Standard Test T 543 and ASTM D 6125-97. A suitable testing apparatus is a Gurley Digital Stiffness Tester Model 4171DS1N manufactured by Teledyne Gurley (514 Fulton Street, Troy, N.Y. 12181-0088). This instrument allows the testing of a wide variety of materials through the use of various lengths and widths in combination with the use of a 5, 25, 50, or 200 gram weight placed in one of three positions on the pointer of the apparatus.

Referring now to the drawings, in all of the figures it will be appreciated that dimensions and relative sizes are not to scale but are chosen to illustrate the package and its various aspects and features.

Referring now to the drawings, FIG. 1 is a front schematic view of a re-closable package 10 in accordance with the present application. The package 10 has a package body 11 formed as a pouch by sealing together two overlaying plastic films. The package body 11 is adapted for enclosing an article or a plurality of articles. The package body 11 has a continuous wall forming the pouch which may be fabricated in a variety of ways, e.g., by providing a tube and sealing one end or folding a sheet and sealing to form a tube then sealing one tube end to form an open ended pouch or by attaching a plurality of wall portions together to form a pouch body. Package bodies (or pouches) may be made by sealing together a plurality of webs, e.g., as a four-sided pouch, or forming a tube. As used throughout this application, the term "bag" includes pouches and flexible packages made from flexible films having 1, 2, 3, 4, 5 or more seals. In one embodiment, two polymeric thermoplastic films are brought together and sealed about a continuous peripheral edge to form a container pouch with a final seal made after depositing item(s) to be held within.

Referring to FIG. 1, the package body 11 has a first body wall portion 12 and a peripheral edge 13 in common with both package body 11 and first body wall portion 12. Also, the common peripheral edge 13 is formed by a first side edge 14 and an opposing second side edge 15, which are connected to one another by a top edge 16 and a spaced apart opposing bottom edge 17, thereby defining a first body wall portion 12 having a first interior surface 18 (see FIG. 7) and a second opposing exterior surface 19. The first body wall portion 12 overlays and is sealed to a similar second body wall portion 20 (see FIG. 3) with a continuous peripheral seal 21 having connected a top seal segment 22, a first side seal segment 23, a bottom seal segment 24, and a second side seal segment 25, thereby forming a hermetically sealed package 10. Seal segments 22, 23, and 25 may be first formed to provide a pouch having an open side at the bottom for subsequent filling with product such as seeds, confections, jewelry beads, screws, etc. After filling, the bottom seal 24 may be made to connect side seals 23 and 25 to form a sealed package 10 containing a product.

The package 10 may be equipped with typical package features to aid, e.g., storage, display and/or initial opening. For example, a hole 26 through top seal segment 22 of the peripheral seal 21 may be provided for placement of the package 10 on a display hanger. Also, initial opening aids may be provided such as a slit or, as illustrated, a notch 27 which is shown in the first side edge 14 and extending into the first side seal segment 23. This notch 27 may be proximate to one or more frangible lines such as score lines 28 to guide a tear which may be manually initiated at the notch 27 and propagated across the package 10 from first side edge 14 to opposing second side edge 15, whereby an upper portion 29 of the package 10 may be removed along with top seal segment 22 to provide initial access to product contained within the package 10. To facilitate this initial opening function, parallel overlaying score lines 28 may be located across the first and second body wall portions 12, 20 and near to, but outside of, the top seal segment 22. In this manner the top seal segment 22 is removed allowing the first body wall portion 12 to be manually displaced from the second body wall portion 20 by, e.g., pulling apart the two respective first and second body wall portions 12, 20 thereby gaining access to an interior space 30 of the package 10 (see FIG. 9). The score lines 28 are also situated above a manually openable, self-shutting closure 31.

Figure 2:
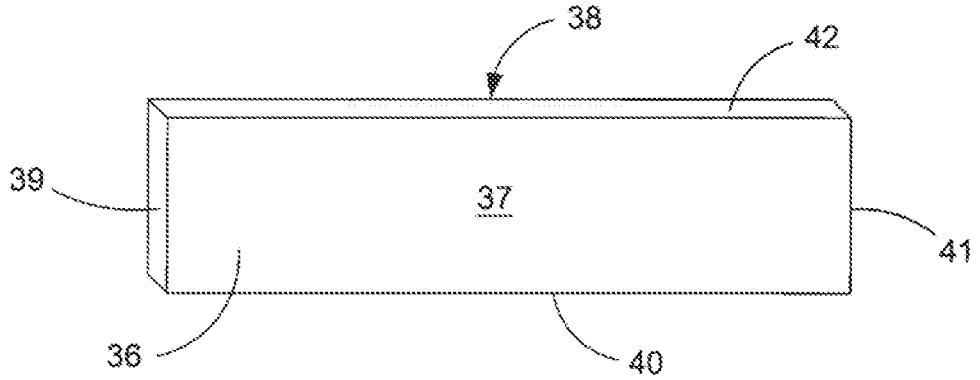
FIG. 2 is an isometric view of a resilient stay.

The closure 31 is formed, in part, from a first resilient, manually deformable stay 36 such as that depicted in FIG. 2. This stay 36 is held in place on the interior surface 18 of first wall portion 12 by an overlaying cover film, such as a heat shrink film, (e.g., cover film 54 (see FIG. 7)) which has an upper edge and opposing lower edge indicated by respective dashed lines 32, 33 (see FIG. 7). After attachment of a heat shrink film to the first wall portion 12, the shrink film is heat activated to shrink causing an upper rolled or bunched edge 34 and lower rolled or bunched edge 35. Alternatively, a rolled or bunched edge may be formed mechanically followed by fastening in place using a non-shrink film, e.g. by heat sealing, ultrasonic welding, the use of adhesives, etc. In one embodiment of the present application at least one rolled edge facilitates opening of the closure 31 during use as further described below. Using two pairs of rolled edges, e.g., each of an upper rolled or bunched edge and a lower rolled or bunched edge on each of the first body wall portion 12 and the second body wall portion 20, with the lower pair acting as a primary closure seal and the upper pair of rolled edges acting as a secondary closure seal, holds the cover film, e.g., a heat shrink film, tautly therebetween, effecting closure as well.

Referring to FIG. 2, a stay 36 may be made from a stiff, resilient material such as a sheet of polyester cut into a parallelepiped shape forming an elongated thin strip. Although many shapes may be employed, see e.g. U.S. Pat. Nos. 3,272,248 and 4,317,478; UK Patent No. GB 2311275; and France Patent No. 1209370, as described in the present application a non-arcuate, flat stay may be used without causing undesirable bowing because of the effect of the rolled edges which act to guide the stays apart from one another during manual opening by compressing together the opposing ends and without necessitating the use of a second hand or other means to pull apart one stay from the other stay. In some embodiments, a flat, non-curved stay without projections, holes, indents, creases or scores may be used. It will be appreciated that, although a stay having a generally rectangular strip shape is shown, a person of ordinary skill in the art may employ stays having other peripheral edges, e.g., shapes which are tubular, dumbbell or have curved top and/or bottom or side shapes and the like. As will be further described below, it is only necessary that the shape permit manual opening by squeezing together the opposing side ends thereby causing central portions of each paired stay to bow outwardly away from each other to create an opening which is self-closing upon release of the manual "pinching" pressure.

Returning to FIG. 2, the stay 36 is shown having a planar front surface 37 and a similar opposing flat rear surface 38 bounded by a periphery formed by stay first side edge 39, stay bottom edge 40, stay second side edge 41, and stay top edge 42. In a typical embodiment, each stay will have a long dimension (i.e., longitudinal side) extending from the stay first side edge 39 to the stay second side edge 41 and a narrower transverse dimension (i.e., side edge) extending from the stay top edge 42 to the stay bottom edge 40. The depth or thickness of the stay from the front surface to the rear surface may be from about 8 mil to about 20 mil (from about 0.20 to about 0.51 millimeters) but may be adjusted as needed to provide the desired stiffness. This type of stay is simple in design, easy to manufacture, and easy to assemble into the package 10. The length of the stay from stay first side edge 39 to the stay second side edge 41 will generally correspond to the flat width of the package in the closure area.

In an alternative embodiment, the opposing stay ends stop just inside the opposing side seal segments where they are "trapped" in place between the seal segments without actually being sealed themselves thereto. Thus, a first and second stay are each held by entrapment within a space defined by a spaced apart attachment of the first and second body wall portions and corresponding first and second cover films.

As described in the present application, a pair of opposing resilient stays, hereinafter denoted 36*a* and 38*b* (see FIG. 7), may generally be utilized in the closure 31 which have a maximum opening dimension of the length (L) in the normal closed position of the closure and a maximum circular opening in a fully open position of the closure which has a circular opening diameter (D) of $2L/\pi$ and an opening area (A) of $L^2/\pi$. In practice, the opening will be less than the maximum and will general have a lens shape. A lens-shaped opening is a two-sided figure formed from two arcuate surfaces; both arcs are convex with respect to the interior of the figure. It has two vertices where the arcs meet. These vertices correspond to pivot points or "hinges" where the ends of a pair of stays meet and are held together.

The stay 36 may be polymeric made of a synthetic resin and have a degree of flexibility and rigidity that facilitates "pinch" opening by manual deformation and a degree of resilience that facilitates self-closing upon release of the "pinching" pressure, whereby the internal tensions and stress memory cause a return of the stay to its original straightened configuration. Thus, a rigid and resilient stay may be used. Stays having a suitable resilient deformability may have a Gurley stiffness of at least about 1000 mg force in both or either MD and/or TD or from about 1000 mg force to about 8000 mg force, or from about 2000 mg force to about 4000 mg force. Stiffness may be altered by various design parameters including the material chosen for the stay, its dimensions including thickness, length and width, shape of the stay (e.g., whether a regular flat planar parallelepiped or elongated tube, or curved strip, or an arcuate or "C" shaped cross-section i.e. being convex on one side and concave on the other either longitudinally or transversely), degree of polymeric cross-linking, attachment mechanism (e.g., whether being held in "trapped" design, or adhered and, if adhered, the adhesive and adhesive coverage), etc. It will be apparent that these design parameters may be selected in accordance with the present teachings without undue experimentation and that the Gurley stiffness range above should not be considered as limiting the package described in the present application in its broadest scope.

Figure 3:
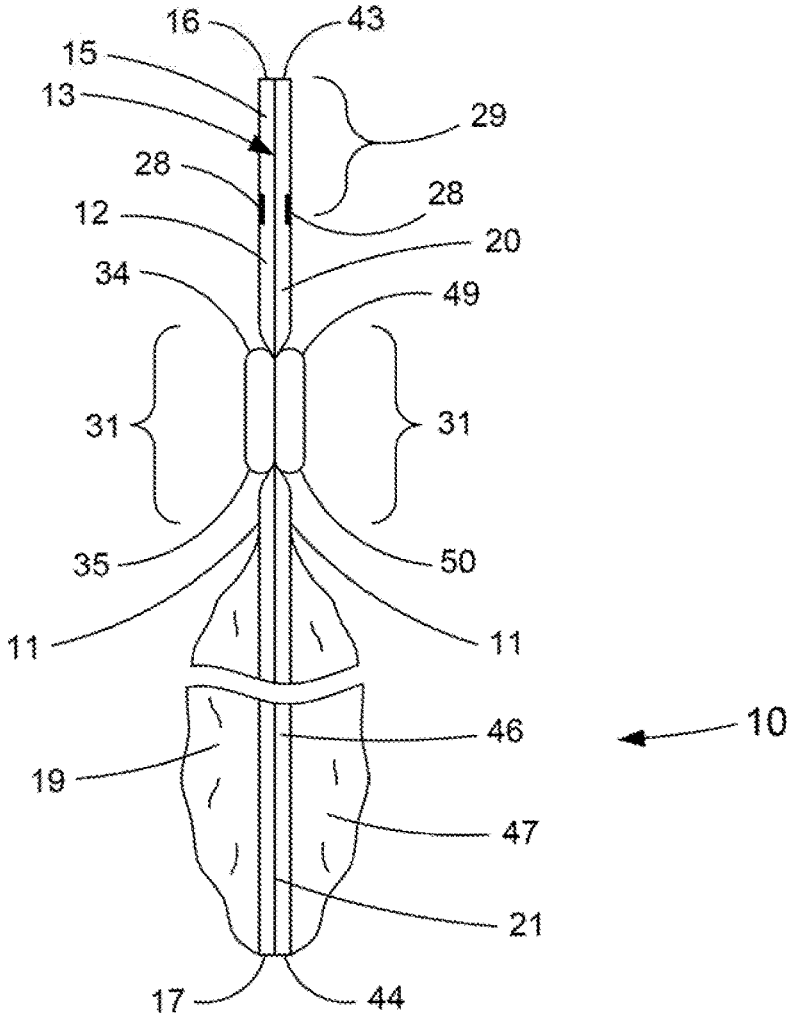
FIG. 3 is a side view of the package of FIG. 1.

Referring now to FIG. 3, a side view of the package 10 of FIG. 1 is presented with the package body 11 comprising a first body wall portion 12 attached to a similar second body wall portion 20 proximate a continuous common peripheral edge 13 by a continuous peripheral seal 21 thereby forming an hermetically sealed package 10. The first body wall portion 12 has an exterior surface 19. The first body wall portion 12 extends along its length from a top edge 16 to a bottom edge 17 and across its width from a first side edge 14 (see FIG. 4) to a second side edge 15. The second body wall portion 20 extends along its length from a top edge 43 to a bottom edge 44 and across its width from a first side edge 45 (see FIG. 4) to a second side edge 46. The second body wall portion 20 has an exterior surface 47 and an opposing interior surface 48 (see FIG. 9). The package 10 also is shown with closure 31 being depicted in a closed position, which is normal for an unopened package and also normal for the package 10 in the absence of a pinching force. Identical score lines 28 overlay each other in the respective first and second body wall portions 12, 20 and function to guide tear propagation to manually remove the upper portion 29 of the package 10 to gain access for opening the package via closure 31. The closure 31 has upper and lower rolled edges 34, 35 in the first body wall portion 12 and has similarly situated upper and lower rolled edges 49, 50 in the second body wall portion 20.

Figure 4:
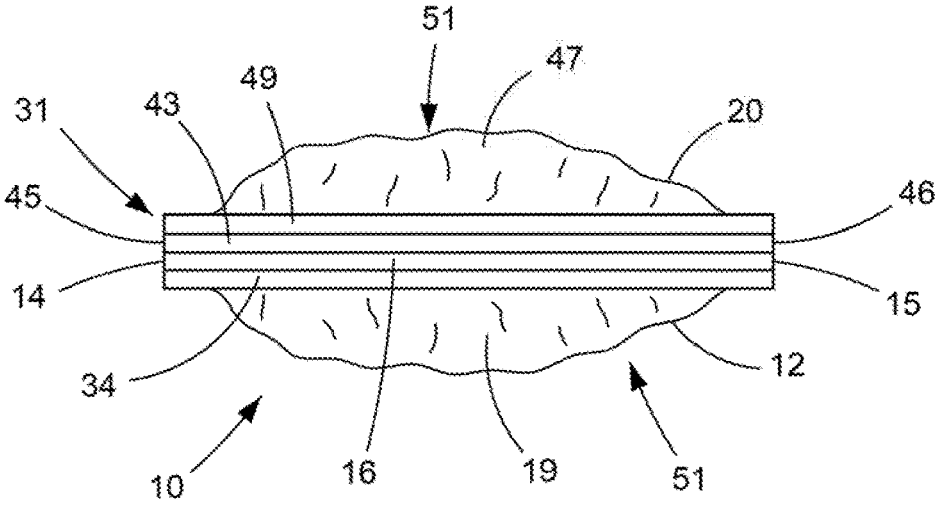
FIG. 4 is a top view of the package of FIG. 1.

Referring now to FIG. 4, a top view of the package 10 of FIG. 1 is depicted showing the first body wall portion 12 having a top edge 16 extending from first side edge 14 to second side edge 15. The first body wall portion 12 has an exterior surface 19, which bulges outwardly in a product holding area 51 due to product contents held within the package 10. A similar second body wall portion 20 has a top edge 43 extending from its first side edge 45 to its second side edge 46 and has an exterior surface 47. Between the bulged-out product containing area 51 and the top edges 16, 43 of the first and second wall portions 12, 20 are upper rolled edges 34, 49 respectively. These rolled edges 34, 49 are part of and proximate to the closure 31.

Figure 5:
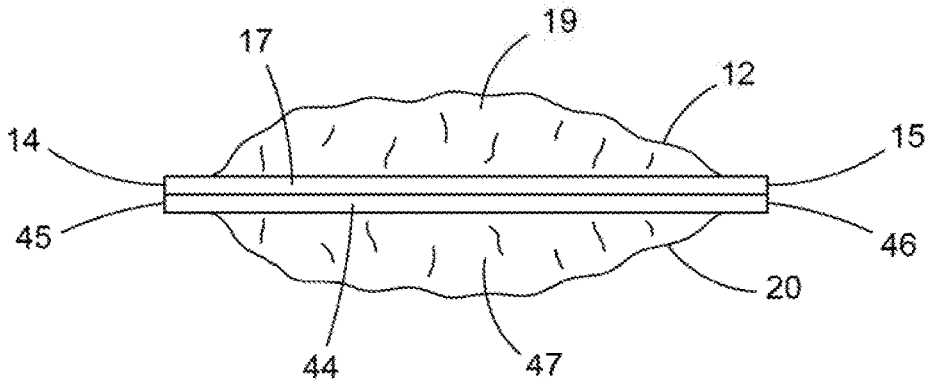
FIG. 5 is a bottom view of the package of FIG. 1.

Referring now to FIG. 5, a bottom view of the package 10 of FIG. 1 is depicted showing first body wall portion 12 having a bottom edge 17 extending from first side edge 14 to second side edge 15. The first wall portion 12 has an exterior surface 19, which bulges outwardly due to product contents held within the package 10. A similar second body wall portion 20 has a bottom edge 44 extending from its first side edge 45 to its second side edge 46 and has an exterior surface 47.

Figure 6:
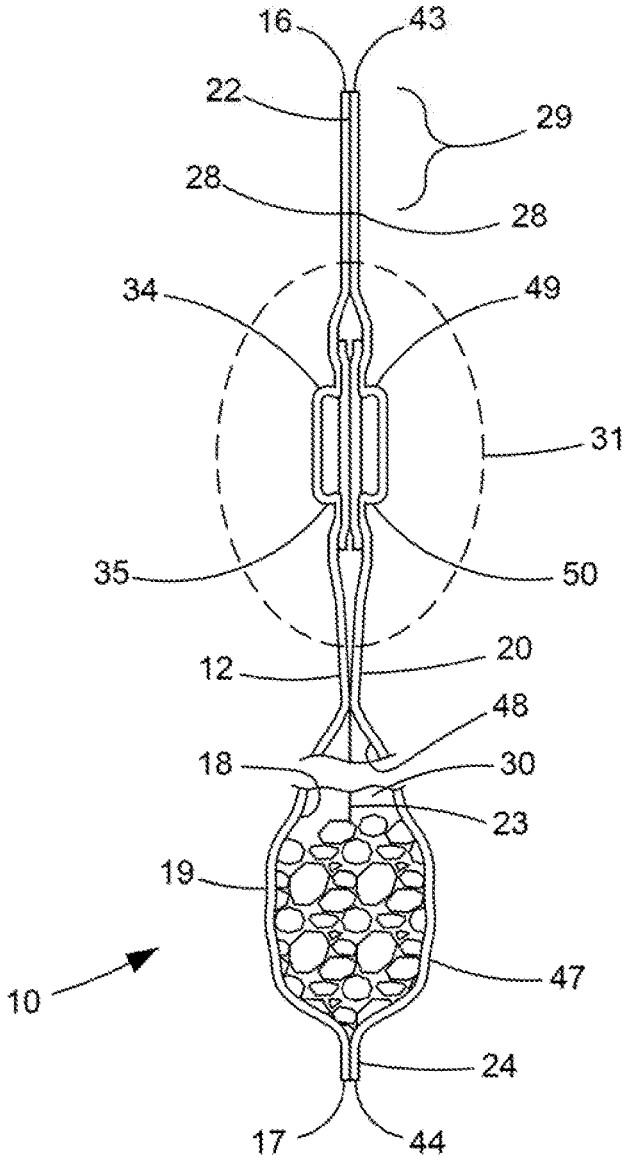
FIG. 6 is a sectional view of the package taken along lines A-A of FIG. 1.

Referring now to FIG. 6, a sectional view of the package 10 of FIG. 1 taken along lines A-A is presented having a first body wall portion 12 attached to a similar second body wall portion 20 having a top seal segment 22 and bottom seal segment 24 and a first side seal segment 23. The first body wall portion 12 has an exterior surface 19 and an opposing interior surface 18. The first body wall portion 12 extends along its length from a top edge 16 to a bottom edge 17. The second body wall portion 20 extends along its length from a top edge 43 to a bottom edge 44. The second body wall portion 20 has an exterior surface 47 and an opposing interior surface 48. First and second body wall portions 12, 20 frame interior space 30. The package 10 also is shown with closure 31 indicated within a dashed line and being depicted in a closed position, which is normal for an unopened package and also normal for the package 10 in the absence of a pinching force. Identical frangible lines or lines of weakness such as score lines 28 overlay each other in the respective first and second body wall portions 12, 20 and function to guide tear propagation to manually remove the upper portion 29 of the package 10 to gain access for opening the package via closure 31. The closure 31 has upper and lower rolled edges 34, 35 in the first body wall portion 12, and has similarly situated upper and lower rolled edges 49, 50 in the second body wall portion 20.

Figure 7:
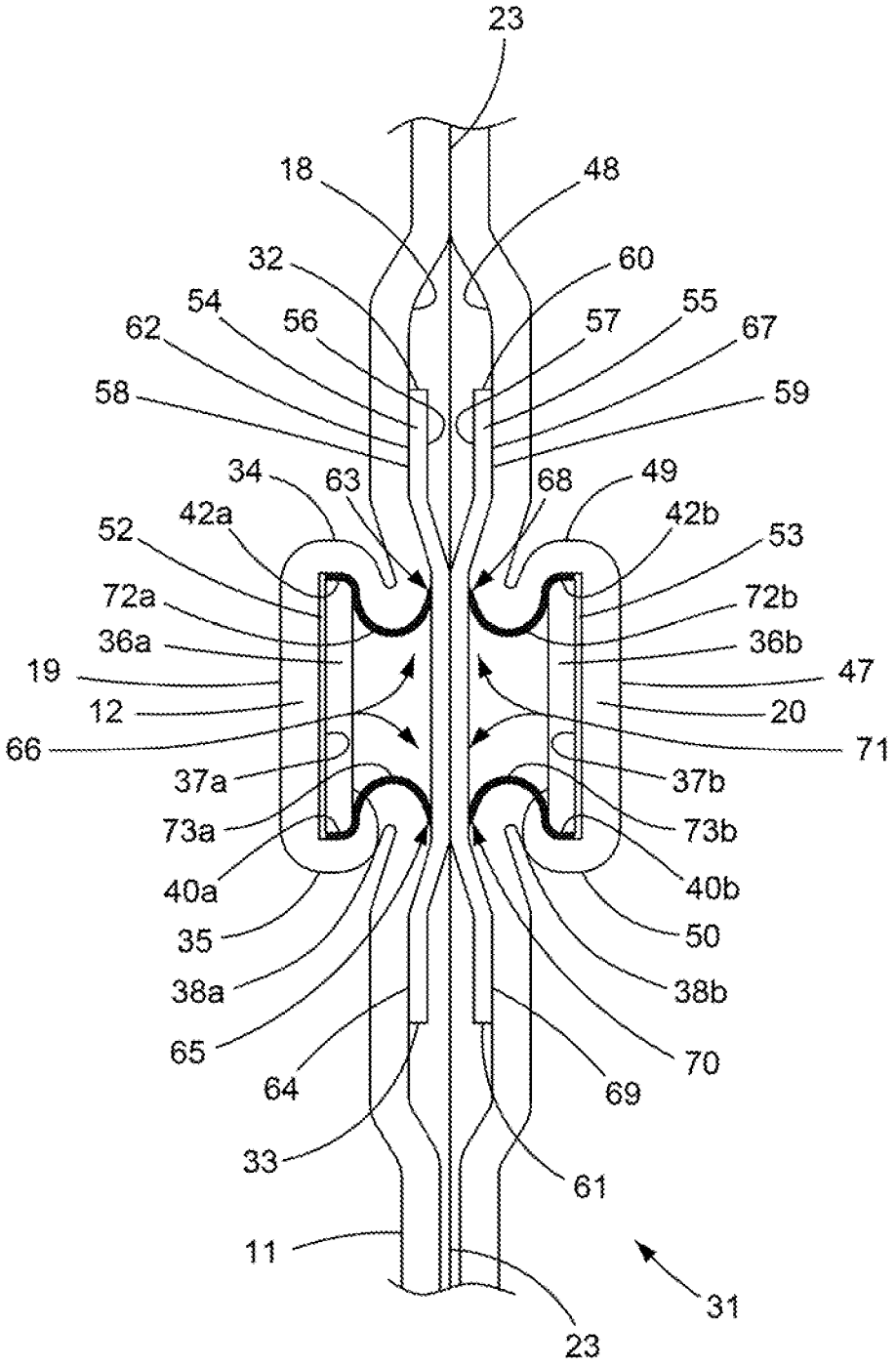
FIG. 7 is an enlarged view of a portion of the sectional view of FIG. 6.

Referring now to FIG. 7, an enlarged schematic view is presented of a section of the closure 31. In this view, as in the other figures in the present application, dimensions, especially thicknesses, are not to scale but are chosen to best illustrate the function and construction of the package described in the present application. The closure 31 is formed from three basic components: resilient stays 36*a*, 36*b*, stay cover films 54, 55, which may be, in some embodiments, heat shrink films, and a package body 11.

FIG. 7 illustrates one embodiment of the closure 31 in which a package body 11 has first and second body wall portions 12, 20, respectively. The first body wall portion 12 has an interior surface 18 and an exterior surface 19 and overlays a similar second body wall portion 20, which also has an exterior surface 47 and an interior surface 48. Typically the interior body wall portion surfaces 18, 48 of the respective first and second body wall portions 12, 20 are not attached to one another except about the periphery of the package and in this illustration only a first side seal segment 23, which lies distally, is depicted. However, the package described in the present application contemplates the possibility of using an easily separable means of attachment even in or adjacent to the closure 31, e.g., by use of well-known pressure sensitive adhesives or peel-reseal adhesive, but these are in no way necessary for the package's utility.

Attached to the interior surfaces 18, 48 of the first and second body wall portions are a pair of resilient, manually deformable stays 36*a*, 36*b* with stay 36*a* being attached to the interior surface 18 by an optional first adhesive layer 52 and stay 36*b* being attached to the interior surface 48 by optional second adhesive layer 53. Alternatively, at least one side of each of the stays 36*a*, 36*b* may be heat sealed to interior body wall portion surfaces 18, 48 respectively. In yet another alternative, the stays 36*a*, 36*b* are not attached to the interior body wall portion surfaces 18, 48, but are trapped in place by means of the cover films 54, 55, e.g., heat shrink films, as described below. Each stay 36*a*, 36*b* has a front surface 37*a*, 37*b* and opposing rear surface 38*a*, 38*b* extending from stay top edges 42*a*, 42*b* to stay bottom edges 40*a*, 40*b*, respectively.

The closure 31 also utilizes cover films 54, 55, and each stay 36*a*, 36*b* is covered at least in part by a first cover film 54 overlaying the first stay 36*a*, and a second cover film 55 overlaying the second stay 36*b*. Each of the cover films 54, 55 has a first surface 56, 57 and opposing second surface 58, 59 extending from an upper edge 32, 60 to an opposing lower edge 33, 61, respectively. The first cover film 54 is attached, e.g., by heat sealing, to the interior surface 18 of the first body wall portion 12 proximate at least two places separated by an unsealed area therebetween. Each of these two places of attachment will be relatively distal from one another and proximate opposing ends 32, 33 of the first cover film 54. Thus, the upper cover film seal 62 of first cover film 54 extends from the upper edge 32 of the first cover film 54 to a first longitudinal line of attachment 63 of the first cover film 54, and the lower cover film seal 64 of the first cover film 54 extends from the lower edge 33 of the first cover film 54 to a second longitudinal line of attachment 65 of the first cover film 54. The first cover film 54 has an unsealed area 66 between the first and second lines of attachment 63, 65. Similarly, the second cover film 55 is attached. e.g., by heat sealing, to the interior surface 48 of the second body wall portion 20 proximate at least two places separated by an unsealed area therebetween. Each of these two places of attachment will be relatively distal from one another and proximate opposing ends 60, 61 of the second cover film 55. Thus, the upper cover film seal 67 of second cover film 55 extends from the upper edge 60 of the second cover film 55 to a first longitudinal line of attachment 68 of the second cover film 55, and the lower cover film seal 69 of the second cover film 55 extends from the lower edge 61 of the second cover film 55 to a second longitudinal line of attachment 70 of the second cover film 55. The second cover film 55 has an unsealed area 71 between the first and second lines of attachment 68, 70.

For each stay 36*a*. 36*b* at least one of their lines of attachment 63, 65, 68, 70 is separated by a longitudinal gap area from proximate respective longitudinal stay edges 40*a*, 42*a* or 40*b*, 42*b*. For each pair of stays 36*a*, 36*b*, this gap area will be located at the top for both, i.e., top gap area 72*a*, 72*b* (indicated in FIG. 7 by a heavy line from the line of attachment to the stay edge) respectively, or at the bottom for both, i.e., bottom gap area 73*a*, 73*b*, (indicated in FIG. 7 by a heavy line from the line of attachment to the stay edge) respectively, or at both top and bottom for both stays 36*a*, 36*b* to provide for symmetrically paired rolled edges as further described herein. Each gap area has a distance from its line of attachment to a proximate stay edge, which may be experimentally determined for each package without undue experimentation. This gap area distance may vary depending upon the exact package configuration and other parameters, such as the materials selected, stiffness, etc. Suitable gap area distances are of from about 0.0625 inch to about 0.3125 inch, or from about 0.0625 to about 0.25 inch, or from about 0.1875 inch to about 0.25 inch. Thus, in one embodiment each of the first and second stays 36*a*, 36*b* has two spaced apart longitudinal unsealed gap areas 72*a*, 73*a*. 72*b*, 73*b*, with one gap area 72*a*, 73*a* adjacent to the first stay edge 42*a*, 42*b* and a second gap area 72*b*, 73*b* adjacent to said second stay edge 40*a*, 40*b* of each respective stay 36*a*, 36*b*. This will produce two pairs of rolled edges 34, 35, 49, 50 for the most efficacious and reliable opening and closing.

In one embodiment, the cover films are heat shrinkable films and each shrink film is attached to its respective wall portion with the shrink direction oriented to cause upper and lower portions of the wall to draw towards one another. Thus, the shrink film may only have shrinkage values and forces in one direction having a longitudinal shrink direction parallel to a line extending from the package top to bottom rather than across the package from side to side. While mono-axial shrink films may be employed, bi-axially stretched shrink films may also be employed as long as the transverse shrink forces are not so great as to cause delamination. It may be that in certain embodiments some transverse shrink force may facilitate the opening features as described in the present application. In any case, optimal shrinkage values and forces may be determined in view of the present disclosure by one of ordinary skill in the art without undue experimentation. Mono-axial shrink films may be made by well-known processes, such as by machine direction orientation (MDO) in which a web of film is run between two sets or paired nip rolls with the take-off nip roller pair being run at a faster speed than the take-up process pair, thereby causing the film to be pulled or stretched in the machine direction. A combination of heating and cooling of the film over the area being stretched causes the film to lock in stresses in an expanded stretched state which remain at room temperature, and these same stresses may be relieved by subjecting the film to elevated temperatures which will cause the film to shrink with force back to its original size as is well known in the art. Other shrink film manufacturing process may also be employed such as tenter frames or double bubble.

Thus, upon heat activation of each cover film 54, 55 as a heat shrinkable film, the distance between the spaced apart sealed areas 62, 64, 67, 69 of each cover film 54, 55 is reduced and each respective gap 72*a*, 73*a*, 72*b*, 73*b* between a sealed area 62, 64, 67, 69 and its proximate top or bottom stay edge 42*a*, 40*a*, 42*b*, 40*b* is effected to pull the respective body wall portion 12, 20 around the top or bottom edge 42*a*, 42*b*, 40*a*, 40*b* of each stay 36*a*, 36*b*, thereby creating upper rolled edges 34, 49 and lower rolled edges 35, 50 in respective body wall portions 12, 20. In one embodiment, having at least two opposing rolled edges 34, 49 or 35, 50 is desirable to reliable opening of the closure 31. In another embodiment, having a pair of opposing rolled edges 34, 49, and 35, 50 at both the top 42*a*, 42*b* and bottom edges 40*a*, 40*b* of the stays 36*a*, 36*b* is desirable to provide the most reliable opening and closing attributes. The opposing rolled edges 34, 49 and 35, 50 function to cause the central areas of each stay 36*a*, 36*b* to spring away from each other when a pinching force is applied to push together the first and second side edges 14, 15 of the package 10 in the area of the closure 31, thereby causing the closure 31 to create an opening for removal, e.g. by pouring, of product contained therein. Once the pinching force is lessened and/or removed, the deformation resistance and resilience of the stays 36*a*, 36*b* cause the first and second body wall portions 12, 20 to return to a flattened configuration, thereby causing the closure 31 to shut and provide sufficient resistance to retain product within the package even if the package is inverted with respect to gravity. This prevents product from spilling out, as further described below with respect to FIG. 9.

Thus, as seen in FIGS. 1-7, a re-closable package 10 as described in the present application is provided having a package body 11 adapted for enclosing an article, with the body 11 having opposing top 16, 43 and bottom edges 17, 44 and first and second body wall portions 12, 20 disposed therebetween. Each of the first and second body wall portions 12, 20 has a first, interior surface 18, 48 defining a package interior and an opposing second, exterior surface 19, 47 defining a package exterior. The first body wall portion 12 and second body wall portion 20 are integrally connected to each other at opposing first 14, 45 and second side edges 15, 46. A closure 31 is connected to the package body 11, and the closure 31 has the following elements:

(i) a first resilient, manually deformable stay 36*a* having a central portion 74*a* (see FIG. 9) between a stay first edge 39*a* and an opposing stay second edge 41*a;*

(ii) a second resilient, manually deformable stay 36*b* having a central portion 74*b* (See FIG. 9) between a stay first edge 39*b* and an opposing stay second edge 41*b;*

(iii) a first polymeric plastic cover film 54 overlaying the first stay 36*a*; and (iv) a second polymeric plastic cover film 55 overlaying the second stay 36*b*.

Each of the first and second stays 36*a*, 36*b* has spaced apart, longitudinal stay (top) edges 42*a*, 42*b*, respectively, and longitudinal stay (bottom) edges 40*a*, 40*b*, respectively. Each stay 36*a*, 36*b* is disposed proximate the package wall interior surfaces 18, 48. The first stay 36*a* is disposed on the first body wall portion 12 and the second stay 36*b* is disposed on the second body wall portion 20 opposite the first stay 36*a*. Each stay 36*a*, 36*b* is in overlaying alignment, and each stay's stay first edge 39*a*, 39*b* may be proximate the first side edge 14, 45 of the body wall 11, and each stay's stay second edge 41*a*, 41*b* may be proximate the second side edge 15, 46 of the body wall 11. The first and second cover films 54, 55 are attached to the interior surface 18, 48 at the first and second body wall portions 12, 20 respectively. Each of the cover films 54, 55 is attached to its interior surface 18, 48 along opposing spaced apart, first and second longitudinal attachment lines, 63, 65 and 68, 70, respectively. The lines of attachment are disposed in a direction corresponding to and in alignment with respective stay top edges 42*a*, 42*b* and stay bottom edges 40*a*, 40*b* to provide at least one pair of longitudinal unsealed gap areas (e.g. 72*a*, 72*b* and 73*a*, 73*b*) between at least one attachment line of each respective cover film 54, 55 and a proximate stay edge. Each of the first and second cover films 54, 55 is attached to the interior surface 18, 48 whereby at least one longitudinal portion of the first body wall portion 12 is transversely bent across at least one gap area 72*a*, 73*a* and at least one longitudinal portion of the second body wall portion 20 is transversely bent across the corresponding gap area 72*b*, 73*b* thereby establishing a pair of opposing rolled edges 34, 49 and/or 35, 50.

Figure 8:
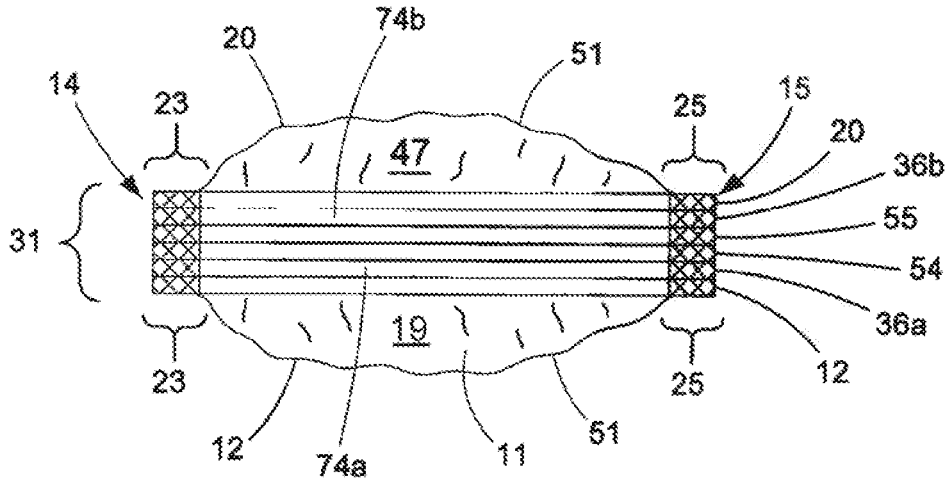
FIG. 8 is a sectional view of the package taken along lines B-B of FIG. 1.

Referring now to FIG. 8, a sectional schematic view along lines B-B of the package 10 of FIG. 1 is depicted. The bulged-out product containing area 51 is shown with the first and second body wall portions 12, 20 having respective exterior surfaces 19, 47. FIG. 8 slices through the closure area 31 and shows sequentially the first body wall portion 12, a first resilient stay 36*a*, a first cover film 54, a second cover film 55, a second resilient stay 36*b*, and second body wall portion 20. These six layers 12, 36*a*, 54, 55, 36*b*, 20 are heat sealed together at a first side seal segment 23 and a second side seal segment 25. Also these six layers have first and second opposing side edges, which, in this embodiment, are all coextensive with first and second side edges 14, 15 of first body wall portion 12 (and first and second side edges 45,46 (not depicted) of second body wall portion 20). Each stay 36*a*, 36*b* has a central stay portion 74*a*. 74*b*, respectively being between said stay first edges 39*a*, 39*b* (not depicted) and stay second edges 41*a*. 41*b* (not depicted). The optional adhesive layer 52, 53 between each stay 36*a*, 36*b* and interior surface 18, 48 as described in FIG. 7 is omitted. In some embodiments it may be advantageous to truncate stay first edges 39*a*, 39*b* and/or stay second edges 41*a*. 41*b*. e.g., just before each of the side seal segments 23, 25 to facilitate heat sealing. In such alternative embodiments the stay first edges 39*a*, 39*b* and stay second edges 41*a*, 41*b* are trapped between the confines of the opposing side seals 23, 25.

FIG. 8 depicts package body 11 having its closure 31 in its normal shut or closed position. There is no pinching force being applied and the stays 36*a*, 36*b* are configured to lie in adjacent non-intersecting planes. The stays are straight within this plane, but may be curved upward or downward with respect to the package top and bottom in an alternative embodiment without destroying closure functionality.

Referring again to FIG. 6, an initial step to opening the package 10 may be performed by tearing open the package 10 along score lines 28 and removing the upper portion 29 of the package to gain access to an inner orifice which continues to be held shut by the closure 31. The package 10 continues to retain its contents against spillage via the normally shut position of closure 31, which holds two sides of the adjacent package in close abutting relationship as best seen in FIG. 8.

Figure 9:
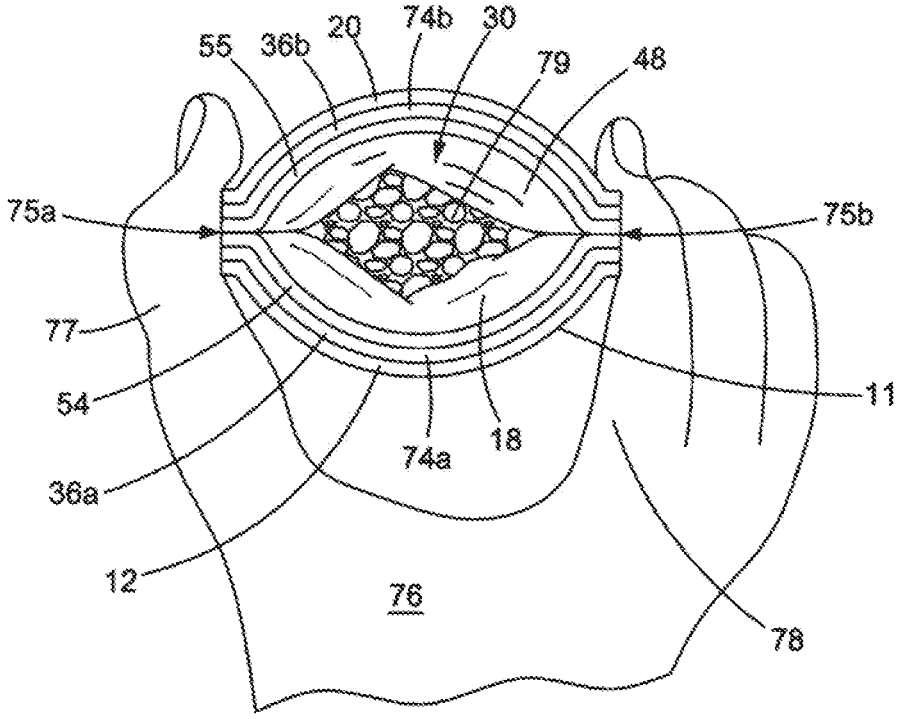
FIG. 9 a schematic plan view showing a portion of a hand holding the package of FIG. 8 in a manually open position.

Referring now to FIG. 9, the closed package body 11 of FIG. 8 is shown after opening and holding the closure 31 in an open position. Following the previously described removal of the upper portion 29, a mouth of the package is created along a perimeter defined by previous score lines 28. To remove contents from the package, manual deformation of the stays 36*a*, 36*b* by squeezing together a first side edge 75*a* and an opposing second side edge 75*b* of package 11 in the area of closure 31 causes the closure 31 to assume a lens shape which is mirrored by the integrally connected peripheral package mouth. As shown in FIG. 9, the package body 11 is in a manually open position with a hand 76 having a thumb 77 and opposing finger 78 causing a pinching force that pushes a first side edge 75*a* and opposing second side edge 75*b* together for a sufficient distance to deform a central stay portion 74*a* of the first resilient stay 36*a* and a central stay portion 74*b* of opposing second resilient stay 36*b* along with attached respective opposing body wall portions 12, 20 and first and second cover films, e.g. shrink films, 54, 55. This deformation causes the central portions 74*a*, 74*b* of each stay 36*a*, 36*b* to bow apart, i.e. outwardly away, from each other with the stays 36*a*, 36*b* being held together at their respective ends adjacent side edges 14, 15 (not depicted). In this open position a continuous passageway from a package interior space 30, bounded by the connected interior surfaces 18, 48, to a space outside the package is provided. The package may then be tilted to pour out or otherwise remove its contents 79, such as, e.g., edible nut pieces.

Advantageously, the package described in the present application may facilitate one-handed opening, closing and re-opening and re-closing of a handheld package. Use of a combination of opposing portions of a cover film, resilient stay and package wall permits formation of interior stresses that facilitate opening by countering inward stay deformation, i.e., countering bending of the central portion of a stay towards the adjacent stay rather than away therefrom. If a stay, for example the first stay 36*a*, bends its central portion 74*a* toward the central portion 74*b* of the second stay 36*b*, then both stays 36*a*, 36*b* will remain in close abutting configuration, and no opening is created sufficient for one to pour out or otherwise remove the contents 79. Without the package described in the present application, such inward deformation may be a frequent occurrence which may frustrate one-handed package opening since a second hand is then required to pull apart the first and second body wall portions 12, 20. Alternative prior art methods of addressing this problem introduce a degree of complexity to assembly of the package and undesirably increase the complexity of the stay design with attendant costs and quality control considerations. It is also believed that rolled edges created by heat activation of shrink cover films and provision of gaps as further described below facilitate return to a shut or closed position once the pinching force is removed by spreading apart the thumb 77 and opposing finger 78.

Figure 10:
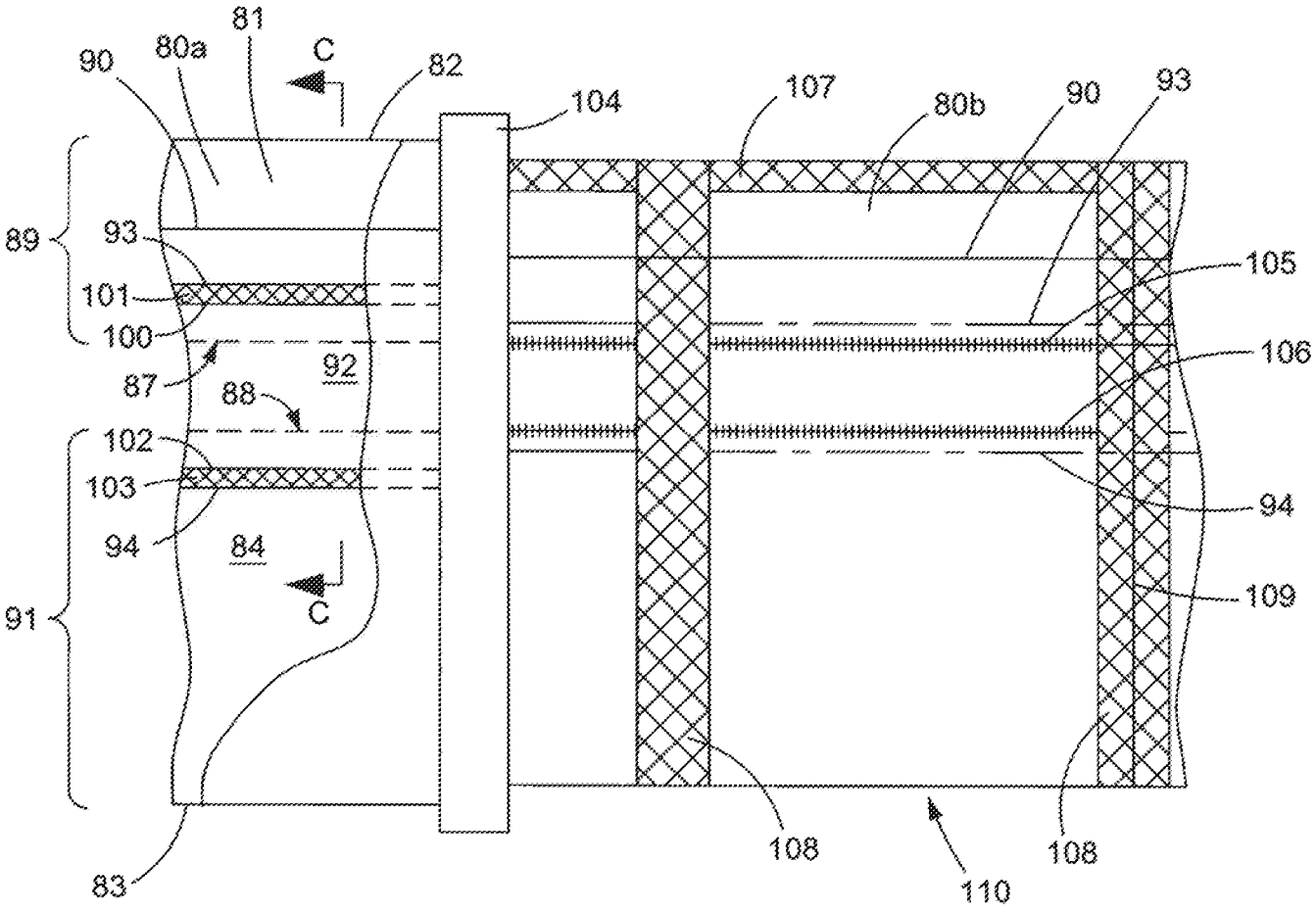
FIG. 10 is a schematic view illustrating a package assembly having a cut away portion.
Figure 11:
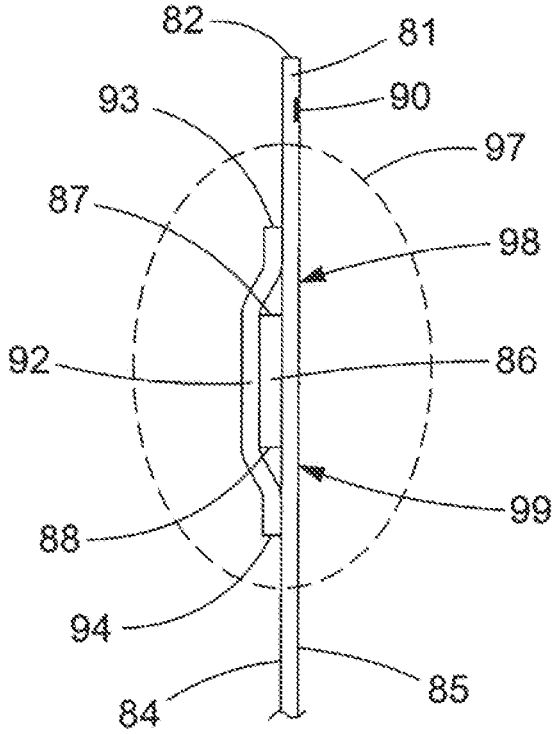
FIG. 11 is a schematic view of the cut away section of the package assembly of FIG. 10 taken along lines C-C.
Figure 12:
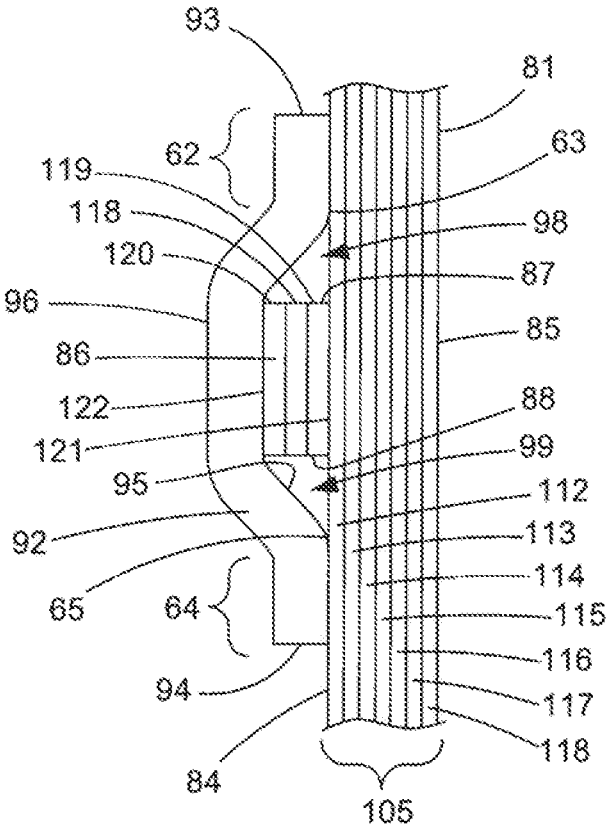
FIG. 12 is an enlarged view of a closure portion of FIG. 11.

Referring now to FIGS. 10-12, a method of constructing one embodiment of a package for one handed opening in accordance with the present application Is. A first sheet 80*a* of flexible thermoplastic polymer package body film 81, having a top edge 82, a bottom edge 83, an interior surface 84, and an exterior surface 85 is provided from a roll (not shown). Upon this unrolled sheet 80*a* is placed a continuous resilient stay 86 having a stay top edge 87 and a stay bottom edge 88, which divides the film into an upper package portion 89 containing score line 90 and lower package portion 91 for receiving package contents. This film 81 when used for, e.g., pourable food pieces such as edible seeds, nuts, granola, chocolates, mints, etc., may be non-foraminous, providing a sanitary barrier against passage across its thickness of dirt, water, insects, odors, or other undesirable things or effects. In other embodiments it may be desirable for the film to be foraminous or have a controlled porosity for such purposes as passage of air, removal of gases or exchange of fluids from the package interior, etc. Over the stay 86 and a portion of the film adjacent thereto is placed a cover film 92, e.g., a heat shrink film, having a top edge 93 and opposing bottom edge 94, a first surface 95, and an opposing second surface 96, which may be provided from a supply film roll (not shown), thereby forming the constituent elements for a closure 97.

In one embodiment, the package body film 81, stay 86, and cover film 92, are continuously provided. The stay 86 is heat sealed to the interior surface 84 of the package body film 81. The cover film 92 is also sealed to the interior surface 84 of the body film 81 but, in some embodiments, is not sealed to the stay 86. The cover film 92 has an unsealed upper gap area 98 and an unsealed lower gap area 99. The upper gap area 98 is the unsealed area of the cover film 92 between (a) an upper longitudinal line of attachment 100 which demarcates the lower boundary of the top cover film seal 101 and (b) the stay top edge 87. The lower gap area 99 is the unsealed area of the cover film 92 between (a) a lower longitudinal line of attachment 102 which demarcates the upper boundary of the bottom cover film seal 103 and (b) the stay bottom edge 88.

A second sheet 80*b* of a similarly constructed package body film, stay and cover film combination is introduced aligned face to face with the first sheet 80*a* so that the interior surfaces of each film sheet abut one another and the stays and cover films are aligned and overlap. The two sheets 80*a*, 80*b* are then passed through a heater 104 where the respective cover films, e.g., cover film 92, are heat activated which causes each to shrink, thereby pulling the upper and lower lines of attachment 100, 102 towards one another across their respective gap areas 98, 99 and causing the package body film 81 in the vicinity of the gap areas 98, 99 to wrap or roll about the stay top and bottom edges 87, 88. This forms a pair of upper rolled edges 105 proximate the opposing stay top edges and a pair of lower rolled edges 106 proximate the opposing stay bottom edges. The two aligned sheets 80*a*, 80*b* are then transported in a machine direction to a heat sealing station (not depicted) where they are conventionally heat sealed together forming, e.g., a top machine direction heat seal 107 and, at a predetermined repeated interval, transverse side heat seals 108 to form individual pouches. These seals are made by methods well known in the art. Each transverse heat seal 108 extends, e.g., from the machine direction top seal 107 to the bottom film edge 83. Also at a predetermined interval, each transverse side seal 108 is severed along its length at severance lines 109 to form separate package pouches having an unsealed bottom opening 110. Product may be filled into the package via the bottom opening 110, which is then heat sealed to provide a hermetically sealed package.

It will be appreciated that many modifications to this exemplary method of package formation may be made. For example, the continuous strip of connected pouches may be filled first and then sealed followed by separation of individual filled pouches. Also, a series of connected pouches may be made with perforations to permit sale of multi-packs that are easily separated one from another by tearing along a row of perforations. In addition, multiple rows of pouches may be made from webs of film, which are then later separated for filing. Configurations of the closure area may also vary. For example the stay, rather than being supplied in a continuous strip may be laid down as individual stays and/or may include an adhesive for temporary or permanent placement on the film. Each of the package body film, stay and cover film may be made of a variety of materials and layers. Monolayer components as well as multilayer components are contemplated, as hereinafter more fully described.

Referring now more specifically to FIG. 11, a schematic view of the cut away section of the package assembly of FIG. 10 taken along lines C-C is shown to depict the closure 97. A package body film 81 having an interior surface 84 and opposing exterior surface 85 is illustrated with an attached stay 86 having a stay top edge 87 and stay bottom edge 88. The stay 86 is covered by cover film 92 which has a top edge 93 and opposing bottom edge 94.

Referring now more specifically to FIG. 12, an exploded view of the closure 97 of FIG. 11 is depicted exemplifying construction of a multilayer film body portion 105 and multilayer stay and the gap areas which are utilized in the formation of rolled edges. Package body film 81 is depicted having an interior surface 84 and exterior surface 85 with a multilayer film body portion 105 having an interior surface layer 112 which acts, e.g., as a heat sealing layer and product contact layer. This layer may be made of any suitable material, such as polyethylenes, such as mLLDPE. In sequential order the next layer is a first intermediate layer 113, which may be an oxygen barrier layer, e.g. EVOH, followed by a second intermediate layer 114, which may be a polyamide or nylon and/or contribute puncture resistance and toughness to the structure. Next is a third intermediate layer 115, which may be a bulk layer, e.g. low cost LDPE, followed by a fourth intermediate layer 116, e.g. LLDPE which may be compatible with LDPE and have good properties for lamination. Next is a fifth intermediate layer 117, e.g. an adhesive layer to adhere the foregoing structure to a printed surface of an outermost exterior surface layer 118, e.g., oriented polypropylene (OPP).

Heat sealed to the interior surface 84 of body film 81 is a first stay surface 121 of a multilayer stay 86 having, e.g., an intermediate core layer 118 of, for example APET, to provide resilient stiffness. In this embodiment, the core layer 118 has a first surface layer 119 and on its opposing side a second surface layer 120. Both layers 119, 120 may be heat sealing layers designed for good lamination resistance and heat sealability. By providing both surfaces of the core layer 118 with a sealant layer 119, 120, manufacturing may be simplified and quality control enhanced since the symmetrical structure permits either side of the stay 86 to be mated with the interior surface 84 of the package body film 81 and sealed thereto.

A cover film 92 having a top edge 93, opposing bottom edge 94 and a first surface 95 and opposing second surface 96 is sealed to package body film 81 producing an upper cover film seal 62 spaced apart from a lower cover film seal 64. An unsealed upper gap area 98 is formed between a first longitudinal line of attachment 63 and the stay top edge 87. An unsealed lower gap area 99 is formed between a second longitudinal line of attachment 65 and the stay bottom edge 88. In this schematic figure the wall film layer thicknesses are exaggerated for clarity of illustration, but it will be appreciated that upon heat activation, a heat shrinkable cover film will pull the first and second lines of attachment 63, 65 closer together with the unsealed portion of the first surface 95 of the cover film 92 sliding over the second stay surface 122 of stay 86 and the attached package body film 81 will be pulled against both the stay top and bottom edges 87, 88 and also may form a slight protrusion or lip just inside upper and lower portions of the second stay surface 122 proximate the stay top and bottom edges 87, 88 respectively. This lip may facilitate both opening, by causing central portions of the stays to bow apart into a lens shape, and closing by displacing the taut cover film 92 of each wall portion against the other to enhance sealing of the closure against unwanted spillage.

Another option for adhesion of a stay to the package body wall and/or cover film is to use an adhesive such as hot glue or a pressure sensitive adhesive (PSA) type material to adhere the stay.

Multipacks of products may be sold together, e.g. with adjacent pouch style packages separable for each other by a line of perforations.

The packages may be printed in many ways as is common in the packaging art including without limitation surface printing, trap printing and the like.

EXAMPLES

Following are examples further illustrating the package described in the present application, but these examples should not be taken as limiting the scope. Any film of suitable thickness may be employed in the package described in the present application. Commercially available shrink films may also be used as may stay materials made from, e.g., commercially available polyester sheet of suitable thickness, stiffness and resiliency for the particular package configuration desired.

Example 1

A resilient deformable stay is made by providing a commercially available 13 mil amorphous polyester (APET) sheet and applying to both sides thereof a 2 mil polyethylene sealant. The APET sheet is both stiff and resilient being able to bend by manual compression, i.e. pinching, between a thumb and opposing finger of a single hand, and also springs back to its original straight and flat configuration upon relaxation and removal of the compressive forces. The applied sealant facilitates heat sealing to, e.g., polyethylene films. It will be appreciated that many materials may be employed that may act as a spring to bend in resilient deformation and upon removal of the pinching compressive forces spring back to an original shape.

In this Example 1, a rigid resilient sheet comprises a structure of LLDPE/LDPE/APET/LDPE/LLDPE and is about 17 mils thick. It may be cut to the desired width and length for use as a stay.

Example 2

A self-shutting, manually re-openable package in accordance with the present application is made by cutting two 3.5 inch wide by 9 inch tall rectangles from a flexible, polymeric, multilayer film. This flexible film is about 3.1 mil thick and has a structure of OPP/adhesive/LDPE/LLDPE/PA/EVOH/mLLDPE. The exterior layer of the film is 70 gage oriented polypropylene (OPP), which is trap printed on its inner surface prior to adhesively laminating the printed film to a substructure made by coating lamination of LDPE and LLDPE to a 1.5 mil coextrusion of PA/EVOH/mLLDPE. Of the combined structure, OPP is the exterior layer and the distal mLLDPE layer is the interior surface layer of the multilayer film and is well suited for heat sealing to itself. This film comprises the package body wall and is used to make two identical wall portions which form a pouch package when sealed together about their periphery.

A resilient stay as described in Example 1 is cut to a flat rectangle having dimensions which are 3.5 inches wide and 0.75 inch high and is healed sealed to the interior surface of each of the two 3.5×9 inch film pieces described above. The symmetrical stay is positioned on each film wall portion by placing a 3.5 inch wide stay across the 3.5 inch width of each film piece on the multilayer film's interior surface so that each stay is parallel to the film top and bottom surfaces and perpendicular to the film side surfaces. The top edge of each stay is located 1 inch from the top edge of each film wall portion, respectively. The bottom edge of each stay is located 1.75 Inches from the top edge of each film wall portion edge and 7.25 inches from the corresponding bottom edge of each film wall portion. After positioning, each stay is heat sealed to its respective film. In this manner two identical wall portions with attached stays are fashioned.

Next each of these stay equipped wall portions is provided with a cover film overlying the stay and an area of the wall portion adjacent to the stay's top and bottom edges. This done by providing a 3.5 inch wide by 1.75 inch high cover film and placing this film over the stay with 0.5 inch of cover film extending above and below the stay top and bottom edges respectively. The stay is thereby covered over its 3.5 inches width. The cover film s next heat sealed proximate its top and bottom edges to form a top seal that is 3.5 inches wide by 0.25 inch high leaving a 0.25 inch unsealed gap area between the top stay edge and the lower edge of the top seal. This seal edge closet to the stay is termed a "line of attachment". A similar 0.25 inch unsealed gap area is created between the bottom stay edge and the upper edge of the bottom cover seal. Thus, two similar wall portions each having an attached stay and attached cover film are made.

In this example, the cover film is made of a machine direction oriented (MDO) polyethylene shrink film having a machine direction free shrink value of about 20% and a transverse direction free shrink value less than 3%. These shrink films also have a maximum shrink force in the machine direction greater than 50 grams at 90° C. and in the transverse direction less than that for the machine direction and, in some embodiments, less than 50 grams at 90° C. The shrink cover film is sealed to the wall portion so that the direction of shrink runs parallel to the side edges. The wall portions with attached stays and shrink film cover films are treated with hot air from a heat gun to cause heat activation of the shrink films. The heat activated shrink films shrink in the machine direction drawing together the wall portion upper and lower lines of attachment pulling each towards the other and pulling the adjacent wall portions along to cause the wall portion films to roll around the top and bottom stay edges creating an upper rolled edge and lower rolled edge on the inside of the stays proximate to the stay top and bottom edges. These rolled edges function to guide the stays from each other during an opening operation as described below.

After shrinking the cover films, there is a residual shrink force that maintains the upper and lower rolled edges. There are now two similar package wall components each having similar closure components comprising the wall portion proximate an attached stay and shrunken cover film with upper and lower rolled edges.

These package wall components are now dimensionally aligned mating the corresponding width and height edges with each other and having the cover film sides facing one another, the interior surface of the wall portions proximate each other, and the exterior OPP surfaces of the two wall components distal from one another. Holding this configuration, the top and opposing side edges of the two wall portion components are sealed together with heat and pressure to form a pouch package having an open bottom. The opposing side seals are about 0.25 inch wide from the peripheral edge and the top seal which extends from one side seal to the other is made about 0.75 inch high extending from the top edge in order to provide room for a centrally located hanger hole which is punched through the top seal.

The so-formed pouch package is filled with product in the form of sunflower seeds through the bottom opening, which is then sealed across its bottom with a 0.25 inch high seal extending from the bottom and proceeding from one side edge proximate the bottom to the opposing side edge proximate the bottom to complete a peripheral hermetic seal in the package containing sunflower seeds.

The above-formed sunflower seed package is initially opened for use by removing the top seal which may be cut off leaving the initially opened package with a self-shutting or self-closing closure formed by the above described pair of closure components.

Access to the contents of the package is accomplished by holding the package in one hand and squeezing the closure area stays by having a thumb adjacent the pair of stays on one side of the package and an opposing finger adjacent the same stays on the opposite side of the package. This squeezing together of the thumb and finger with the package pinched therebetween causes the opposing package sides to compress towards each other resulting in central portions of each stay (and the connected package wall portions) to bow apart outward from each other being held together at each opposing side edge by the side seals. This bowing produces a lens-shaped opening or package mouth similar to that seen in FIG. 9.

Thus the pair of stays are held together proximate opposing package side edges in the side seal areas forming hinges or pivot points while the stay body between these hinges is free to bend in response to the compressive forces being applied by the pinching action of thumb and finger. These compressive forces will overcome the natural tendency of each stay to remain in its original unstressed flat straight configuration. If both stays bend in the same direction, the package however will not open but instead will form an arc with both stay bodies led against one another in the same curved shape. In order to open, the stay bodies must bend in opposite directions away from each other. In the package Example 2, this is what happens with each pair of upper and lower rolled edges acting to direct each stay to bend away from each other and the rolled edges therebetween. While only a single pair of rolled edges is needed proximate either the upper edges, or alternatively a pair at the lower edges of the stays, the reliability of opening and especially closing may be enhanced by using a pair of rolled edges at both the top and bottom.

The package held with the closure open may be tilted for dispensing product. After the desired amount of seeds have been poured out, the package is returned to an upright position and the thumb and finger spread apart to allow the natural resiliency of and material memory of the stays to spring back and close the package mouth. Thus, releasing the opening compressive forces to a point where they are less than the resistance to bending of the naturally straight and flat stays causes the closure to operate to seal shut the package. The package may then be inverted and the seal is sufficient to prevent spillage of its contents. The package in an upside down position under the force of gravity will retain its contents absent a compressive force sufficient to cause the stays to bend apart and open. Without this compressive force, the sunflower seeds are securely held within its interior. Repeated pinching of the closure in the manner described above reliably opens the package without same direction bowing, which would defeat opening. The package also has good closing performance where it closes completely so that, if inverted without application of the compressive forces or pinching action upon the closure ends, no product falls out.

Example 3

In Example 3, the same materials and process are employed as for Example 2 except the flexible film is replaced with a different flexible film. The flexible film of Example 3 is about 3.75 mil thick and has a structure of OPET/adhesive/EVOH/LLDPE. The exterior layer of the film is 75 gage oriented polyethylene terephthalate (OPET) which is adhesively laminated to a 3 mil coextrusion comprising EVOH and LLDPE. Of the combined structure, OPET is the exterior layer and the distal LLDPE layer is the interior surface layer of the multilayer film and is well suited for heat sealing to itself. This film comprises the package body wall and is used to make two identical wall portions, which form a pouch package when sealed together about their periphery. The remainder of the process and package is the same as Example 2.

Example 4

In Example 4 the same materials and process are employed as for Example 2 except the shrink cover films are replaced with non-shrink films and the rolled edges are made as follows: After the stays are sealed to the wall portions, 0.25 inch of the wall portion film adjacent to the top stay edge is physically rolled around the top stay edge and adhered thereto with an adhesive. Similarly 0.25 inch of the wall portion adjacent the bottom stay edge is rolled around that edge and adhered thereto. A non-shrink cover film is then placed overlaying the stay, and its upper and lower rolled edges and the cover film held taut and heat sealed to the rolled edges for a width of about 0.25 inch extending form the rolled edge away from the stay, i.e., being left unsealed between the upper and lower rolled edges. The remainder of the process and description is the same. The non-shrink film has less than 5% free shrink in both the machine and transverse directions. Although potentially more complicated to make, this embodiment is also expected to have good results increasing both opening and closing reliability over a similar product made without rolled edges or ridges.

Examples 5-8

Example 5 is a comparative example and Examples 6-8 are examples of the package described in the present application. For Examples 5-8, pouch packages were made similar to the package and materials described above for Example 2, except as hereinafter described. These examples compared use of a non-shrink cover film without rolled edges (Comparative Example 5) to films using shrink films with only a pair of lower rolled edges (Example 6), only upper rolled edges (Example 7) and with both upper and lower rolled edges but with a trapped rather than sealed in place stay (Example 8).

In Examples 5-8, all pouches were made to have a 3.5 Inch width and 5.0 inch height. The same materials were used, except in Example 5 a polyethylene based non-shrink cover film having less than 5% free shrink in both machine and transverse directions at 90° C. and having less than 50 grams maximum shrink force in both directions was used without formation of any rolled edges.

The pouch package body wall film and stays used for Examples 5-8 were similar to those used for Example 2 except the stays had 0.75 inch height. Also, for all examples, 0.1875 inch gap areas were used as further described below.

Comparative Example 5 had both an upper and lower gap area, each being 0.1875 inch between their respective stay edge and nearby or proximate line of attachment. Two samples of the Comparative Example 5 pouch were made. Heat was applied but no rolled edges were formed either by heat activated shrink forces or by mechanical means, physical means, through use of adhesives, or otherwise. The resultant package had poor opening performance exhibiting a tendency for the stays and connected package wall portions to bow in the same direction so that opening was unreliable. Similarly, the closing performance for these samples was poor with product falling out of each sample during inversion.

In Example 6, heat shrink cover film was used and heat activated. Three samples were made and tested having a pair of opposing lower rolled edges only. The lower gap area was 0.1875 Inch proximate each bottom stay edge. There was no upper gap area. The upper line of attachment coincided with the upper stay edge. The upper interior surface of the wall portion proximate to the top stay edge was heat sealed to the cover film right up to the top stay edge to prevent formation of an upper rolled edge or ridge. Upon heat activation, the unsealed area of the shrink film between the upper line of attachment and lower line of attachment contracted causing the lower 0.1875 inch gap area to conform around the bottom stay edge creating a lower rolled edge while no upper rolled edge was formed.

After filling and sealing, the pouches of Example 6 were tested for opening and closing as described in Example 2. The samples all showed good opening performance without same direction bowing or arcing. The bottom rolled edges were sufficient to reliably facilitate and direct opening by causing the opposing central portions of the stays and connected package body wall to bow apart to open the package and create a lens-shaped mouth opening. In closing tests the performance was rated fair, with some product occasionally entering the closure area proximate the stays without completely falling out of the package.

In Example 7, heat shrink cover film was used and heat activated. Two samples were made and tested having a pair of opposing upper rolled edges only. The upper gap area was 0.1875 Inch proximate each top stay edge. There was no lower gap area. The lower line of attachment coincided with the bottom stay edge. The lower interior surface of the wall portion proximate to the bottom stay edge was heat sealed to the cover film right up to the bottom stay edge to prevent formation of a lower rolled edge or ridge. Upon heat activation, the unsealed area of the shrink film between the lower line of attachment and upper line of attachment contracted causing the upper 0.1875 inch gap area to conform around the top stay edge creating an upper rolled edge while no lower rolled edge was formed.

After filling and sealing, the pouches of Example 7 were tested for opening and closing as described in Example 2. The samples all showed good opening performance without same direction bowing or arcing. The top rolled edges were sufficient to reliably facilitate and direct opening by causing the opposing central portions of the stays and connected package body wall to bow apart to open the package and create a lens-shaped mouth opening. In closing tests the performance was rated good, with no product entering the closure area proximate the stays and none failing out of the package.

In Example 8, three samples were made and tested. In these samples a gap area of 0.1875 inch was provided at both the top and bottom of the stays but the stays were not sealed to any film, i.e., were sealed to neither the wall portion nor the cover film. In these samples, the stays were cut 0.5 inch shorter in width to lie out of the 0.25 Inch side seals. Instead of being sealed, the stays in Example 8, upon heat activation and shrinkage of the shrink films, were trapped inside the confines of the wag portion and opposing cover film bounded by the lines of attachment at the top and bottom and by the opposing side seals. The samples of Example 8 were tested as above and found to have good opening performance and poor closing performance.

In Examples 6-8, the opening performance was enhanced by addition of a rolled edge. It is demonstrated that rolled edges prevent undesirable same direction bowing during attempts to open the closure by application of pinching or compression forces along the opposing package sides proximate the stay side edges. Instead, the rolled edges facilitate bowing apart of the stay central portions in opposite directions to reliably form a lens-shaped mouth or opening for access to the package contents.

In one embodiment, rolled edges are provided at both top and bottom of sealed stays and utilized with shrink cover films to provide both reliably good opening and closing performance.

Suitable gap area distances may be determined experimentally, but it is believed that gap area distances of from about 0.0625 to 0.3125 Inch are beneficial. Further testing has revealed that for packages of about 3.5 inches width, gap areas between about 0.1875 and 0.25 inch may work best for the dimensions, degree of stiffness, resiliency and types of stays, and wall portions used in the examples to provide good reliable performance for both opening and closing. Increasing the gap to 0.3125 inch may decrease opening performance to fair and closing performance to poor. Decreasing the gap to 0.125 inch or 0.0625 inch may decrease performance to fair for both opening and closing.

It will be understood that gap areas may vary as may other parameters such as the thickness of the body wall, stay and package wall stiffness, shrink percentages and forces of the cover films, package dimensions, stay thickness and other dimensions, choice of materials for the stay, wall and cover films, product weight, product size, product shape, package dimensions, etc. Selection of design parameter may necessitate or affect the range of choices for other design parameters. For any particular package these parameters may be selected, determined and optimized without undue experimentation in view of the present teachings.

Package Wall Construction

The package wall for the package described in the present application may be provided as polymeric thermoplastic flexible film, which may be produced or obtained as roll-stock and used in the form of a web, as depicted above, to which various operations may be applied to make a package having a closure in accordance with the present application. This wall film may be of monolayer construction or it may comprise a plurality of layers. It will be appreciated that a variety of film compositions and structures may be employed. For example, the package wall film may have a product contact surface which may be designed with desirable properties for contact with the product to be packaged, e.g. Inertness, heat sealability, etc., and may also have suitable properties of abrasion resistance, porosity, impermeability to various substances, etc. Other functional layers may be present as intermediate layers and have various properties, for example, gas barrier properties, e.g. oxygen barrier properties, such as may be provided by EVOH or nylon containing layers. Polyethylene containing layers as surface layers and/or intermediate layers may provide water barrier properties. Each layer may also be designed for good adherence to adjacent layers, and special adhesive polymers may be used alone or blended with layers to enhance delamination resistance. The film structure may also be designed to have puncture resistance, e.g., to sharp points and edges that may be present in certain products for packaging such as screws, or edible nuts and seeds.

In the present application, the terms "bag" and "pouch" are used interchangeably. A variety of known thermoplastic bag constructions may be used with the package described in the present application depending upon the product to be packaged and the functional requirements for the intended product and use. Advantageously, a portion of the surface area of the package wall may provide visual access to the inside of the bag, if desired, by use of transparent materials.

Film Thickness

The packaging films for the bag construction may have a total thickness of less than about 10 mil or of from about 1 mil to 10 mil (25-254 micron (μ)). In some embodiments, the packaging films may have a thickness from about 1 to 5 mil, with certain typical embodiments being from about 1.75 to 3.5 mil. For example, the entire bag film may have any suitable thicknesses, including. e.g., 1, 2, 3, 4, or 5 mil, or any increment of 0.1 or 0.01 mil therebetween. Although suitable bag films for packaging as thick as 5 mil (127 micron) or higher, or as thin as 1 mil (25.4 microns) or less may be made, it is expected that the most common films will be between about 2.5-3.5 mil (63.5-88.9 micron). Such films may also have good abuse resistance and machinability.

Film Layers

The bag may be a monolayer or a multilayer construction. Films of 1, 2, 3, 4, 5, 6, 7, 8, 9, 10, or more layers are contemplated for the pouch. For some products, a monolayer film, e.g., of a polyolefin such as polyethylene or polypropylene, LLDPE, or EVA, or a blend of polyolefins, may be used. For other products, performance requirements may be satisfied by a two or three layer film, e.g., by coupling PET with a heat sealable layer of polyolefin or by placing an oxygen and moisture barrier polymer such as PVDC between a heat seal layer of polyolefin and an abuse resistant layer of another polyolefin. In applications for which higher performance or specific properties are desired even more layers may be used. If multilayer, one or more layers may be employed in the bag construction to provide the desired functionality. Alternatively, or additionally, polymers may be selected and blended to provide a layer with multiple functions in either monolayer or multilayer embodiments. Multiple layers may be utilized to provide specific functionality to the pouch, although any single layer may have adequate properties for multiple functionalities.

One or more functional properties may be contributed by one or more layers including desired levels of heat sealability, optical properties (e.g. transparency, gloss, haze), abrasion resistance, coefficient of friction, tensile strength, flex crack resistance, puncture resistance, controlled rupture, printability, colorfastness, flexibility, dimensional stability, barrier properties to gases, such as oxygen, to moisture, and/or to light of broad or narrow spectrum including, e.g. uv resistance, etc.

Thus, the package described in the present application may use films that may include additional layers or polymers to add or modify various properties of the desired film such as heat sealability, interlayer adhesion, wrinkle resistance, flexibility, conformability, puncture resistance, printability, toughness, aroma barrier, gas and/or water barrier properties, abrasion resistance, printability, and optical properties such as clarity, transparency, haze, gloss, color, reflectivity, iridescence, luminescence, and/or freedom from lines, streaks or gels. These layers may be formed by any suitable method including coextrusion, extrusion coating and/or lamination. Various types of exemplary functions and layers are described below.

Article Contact/Heat Sealing Layers

Every pouch will have an article contact layer. This layer is often designed to also be heat sealable since heat sealing is a convenient and secure way of forming and sealing a hermetic package. Other means of sealing such as by use of adhesives may be used instead of heat sealing or in addition thereto. A variety of article contact/heat seal layers may be employed with the package described in the present application. These may include, without limitation, polyolefins such as polypropylene or polyethylene, PVC, etc.

Barrier Layers

A primary function of packaging may be to provide a barrier against various undesirable physical, chemical or biological contaminants or forces. Often specialized layers are provided for enhanced effectiveness against particular deleterious phenomena. Thus, a specialized barrier layer may function both as a highly effective gas barrier layer and as a moisture barrier layer, although these functions may be provided by separate layers. The gas barrier layer is typically an oxygen barrier layer since oxygen often has detrimental effects on shelf life and, for certain items, taste or odor. An oxygen barrier may be a core layer positioned between and protected by surface layers. For example, the oxygen barrier layer may be in contact with a first surface layer and an adhesive layer or may be sandwiched between two tie layers and/or two surface layers.

The packaging film may utilize a gas barrier layer utilizing materials, such as polyvinylidene chloride copolymers, such as saran, or ethylene vinyl alcohol copolymers, which provide high barriers to gas permeability. An oxygen barrier material may be selected to provide an oxygen permeability sufficiently diminished to protect the packaged article from undesirable deterioration or oxidative processes. A reduced oxygen permeability helps prevent or delay oxidation of oxygen sensitive articles and substances to be packaged in the film. For packaging oxygen sensitive products, the films may have an oxygen barrier transmission rate ($O_2TR$) of less than or equal to 20 (more desirably ≤10) $cm^3/100\ in^2$ per 24 hours at 1 atmosphere, 23° C. and 0% relative humidity (RH).

In accordance with the present application, the film may utilize a moisture barrier layer, such as polyvinylidene chloride copolymers, such as saran, or polyolefin materials, such as HDPE, which impede moisture vapor permeation. A water or moisture barrier may be selected to provide a moisture permeability sufficiently diminished to protect the packaged article from undesirable deterioration. Moisture barriers may also be used to protect the functionality of other packaging materials which may be water sensitive. For example, a film may comprise a water barrier having a moisture permeability that is low enough to prevent undesirable interaction with contained product which may be, e.g., hygroscopic in nature. In addition, it may protect a material such as EVOH which is often used as an oxygen barrier but whose oxygen properties deteriorate in the presence of water. The films described in the present application may have a water vapor transmission rate (WVTR) of less than 0.5 g/100 $inch^2$ per 24 hours at 100° F. and 90% relative humidity (R.H.).

An oxygen barrier layer may comprise EVOH, polyvinylidene chloride, polyamide, polyester, polyalkylene carbonate, polyacrylonitrile, metal foil, and/or other materials as known to those of skill in the art. Suitable moisture barrier layers may include polyolefins such as LDPE, MDPE, HDPE, PP, or LLDPE, as well as PCTFE, PVDC, and/other materials as known to those of skill in the art.

The thickness of the barrier layer(s) may be selected to provide the combination of the performance properties sought, e.g., with respect to oxygen permeability and water barrier properties. Suitable thicknesses in multilayer films for a polymeric $O_2$ barrier may be less than 15%, e.g. from 3 to 13%, of the total film thickness or less than about 10% of the total thickness of the multilayer film. For example, the thickness of a core oxygen barrier layer may be less than about 0.45 mil (10.16 microns) and greater than about 0.05 mil (1.27 microns), including, e.g., 0.10, 0.20, 0.25, 0.30, 0.40, or 0.45 mil thick. Thus, the thickness of this $O_2$ barrier core layer may be varied and may be from about 0.05 to about 0.60 mils (1.3-15.2 microns). However, thinner or thicker oxygen barrier layers or multiple layers may be used as well to achieve the desired barrier properties.

The oxygen barrier layer of a film may comprise EVOH, although oxygen barrier layers comprising polyvinylidene chloride-vinyl chloride copolymer (PVDC or VDC-VC) or vinylidene chloride-methylacrylate copolymer (VDC-MA) as well as blends thereof, may also be used as may other known transparent or translucent oxygen barrier materials. Exemplary of commercially available ethylene/vinyl alcohol copolymers suitable for use include the SOARNOL® family of resins, e.g., SOARNOL® ET3803 grade, a 38 mol % EVOH having a reported bulk density of 0.64-0.74 g/$cm^3$, a relative density of 1.13-1.22 g/$cm^3$ and a melting point of 164-188° C., which may be obtained from The Nippon Synthetic Chemical Industry Company, Ltd. (Nippon Gohsei), Osaka, Japan. Another example of an EVOH that may be acceptable may be purchased from Nippon Gohsei under the trade name Soarnol® DT2904 (29 mol % ethylene).

Bulk Layers

A bulk layer may be provided to provide additional functionality such as stiffness or heat sealability or to improve machinability, cost, flexibility, barrier properties, etc. Bulk layers may comprise one or more polyolefins such as polyethylene, ethylene-alpha olefin copolymers (EAO), polypropylene, polybutene, ethylene copolymers having a majority amount by weight of ethylene polymerized with a lesser amount of a comonomer such as vinyl acetate, and other polymeric resins falling in the "olefin" family classification. The bulk layer may be of any suitable thickness, such as from 0.1 to 7 mils, or may even be omitted for use in certain applications. It may be present to improve stiffness/flexibility properties and heat sealability.

Abuse-Resistant Outer Layer

The film may provide abrasion and puncture resistance, and for these reasons it may include an abuse-resistant layer. As the exterior surface layer of the film, this layer is also the exterior layer of a pouch or other container made from the film and is therefore subject to handling and abuse, e.g., from equipment during packaging and from rubbing against other packages and box interior walls, not only in the packaging process, but also during transport, storage, display and use. Surface contact with abrasive forces, stresses and pressures may abrade the film, causing defects which may diminish optical characteristics or causing punctures or breaches in the integrity of the package. Therefore, the exterior surface layer may be made from materials chosen to be resistant to abrasive and puncture forces and other stresses and abuse, which the packaging may encounter during packaging, shipping, and use. Suitable stiffness, flexibility, flex crack resistance, modulus, tensile strength, coefficient of friction, printability, and optical properties may also be designed into exterior layers by suitable choice of materials. This layer may also be chosen to have characteristics suitable for creating desired heat seals which may be heat resistance to burn through, e.g., by impulse sealers or may be used as a heat sealing surface in certain package embodiments, e.g. using overlap seals.

The exterior surface layer thickness may be 0.2 to 2.0 mil. Thinner layers may be less effective for abuse resistance. Thicker layers may be used to produce films having unique higher abuse resistance properties but may be more expensive.

Intermediate Layers

An intermediate layer is any layer between the exterior layer and the interior layer of the pouch film and may include specialized barrier layers, tie layers, or layers having functional attributes useful for the film structure or its intended uses. Intermediate layers may be used to improve, impart or otherwise modify a multitude of characteristics, such as printability for trap printed structures, machinability, tensile properties, flexibility, stiffness, modulus, designed delamination, tear properties, strength, elongation, optical, moisture barrier, oxygen or other gas barrier, radiation selection or barrier, e.g., to ultraviolet (UV) wavelengths, etc. Suitable intermediate layers may include adhesives, adhesive polymers, polyolefin, oriented polyester, amorphous polyester, polyamide, nylon, or copolymers, blends or derivatives thereof, as well as metal foils. As a non-limiting example, a pouch may be made by sealing together (i) a back web having an opaque reflective metal foil and (ii) a transparent, metal-foil-free front web. Suitable polyolefins may include polyethylene, ethylene-alpha olefin copolymers (EAO), polypropylene, ethylene copolymers having a majority amount by weight of ethylene polymerized with a lesser amount of a comonomer such as vinyl acetate, other polymeric resins falling in the "olefin" family classification, LDPE, HDPE, LLDPE, ionomer, EMA, EAA, modified polyolefins, e.g. anhydride grafted ethylene polymers, etc.

Tie Layers

One type of intermediate layer is an adhesive layer, also known in the art as "tie layer," which may be selected to promote the adherence of adjacent layers to one another in a multilayer film and prevent undesirable delamination. A multifunctional tie layer may be formulated to aid in the adherence of one layer to another layer without the need of using separate specialty adhesives by virtue of the compatibility of the materials in the tie layer to the adjacent "tied"

first and second layers. In some embodiments, adhesive tie layers may comprise materials found in both the first and second tied layers. In other embodiments, specialty adhesive resins, such as anhydride modified polyolefins, may be required, either alone or in blends with other polymers. Exemplary of commercially available anhydride-modified linear low-density polyethylenes (modLLDPE) suitable for use include the BYNEL® family of resins, e.g., BYNEL®41E710 grade having a reported melt index of 2.7 dg/min (at 190° C.), a density of 0.91 g/cm$^3$, and a melting point of 115° C., which is supplied by E. I. du Pont de Nemours and Company, Wilmington, Del., U.S.A. The adhesive layer may be less than 10% or between 2% and 10% of the overall thickness of the multilayer film. In one embodiment, a multilayer film may comprise a structure having a first adhesive layer positioned between and in direct contact with the exterior layer and a core oxygen barrier layer and optionally a second tie layer positioned between and in direct contact with the opposite side of the same core oxygen barrier layer and the interior layer to produce a five layer film. Adhesive layers may include modified, e.g., anhydride modified, polymers, e.g. polyolefins such as polyethylenes or ethylene copolymers such as EVA and may also be primers or specialty adhesive resins.

Multilayer films may comprise any suitable number of tie or adhesive layers of any suitable composition. Various adhesive layers may be formulated and positioned to provide a desired level of adhesive between specific layers of the film according to the composition of the layers contacted by the tie layers.

Adhesives useful in the package described in the present application include permanent adhesives, hot melt adhesives, modified polymer adhesives and polymer resins commonly available from many commercial sources. It is contemplated that acrylic and anhydride modified polymers may be employed as well as many adhesives which may be selected depending upon the materials to be attached and equipment utilized.

Optional Additives to Layers

Various additives may be included in the polymers utilized in one or more of the exterior, interior and intermediate or tie layers of packaging film described in the present application. Additives and processing aides; natural and synthetic colorants, pigments and dyes; and antimicrobial agents may be incorporated into or coated on one or more layers of the multilayer films described. Thus, conventional anti-oxidants; anti-block additives; plasticizers; acid, moisture or gas (such as oxygen) scavengers; slip agents; colorants; dyes; pigments; organoleptic agents; antimicrobial agents; and mixtures thereof may be added to one or more film layers of the film. Alternatively, individual layers or the entire film may be free from such added ingredients. The pouch film or portions thereof may be transparent or opaque to provide visibility or attractive colors, designs, printing, product information, instructions, etc. At least a portion of the pouch film may be transparent to provide visual access between the exterior environment of an observer and the bag contents. Additives and processing aides may be used in amounts less than 10% or less than 7% or less than 5% of the layer weight.

In one embodiment, the package may advantageously employ a pouch or bag container multilayer film having (a) a product contents contact interior layer of a food grade polyolefin polymer or blends thereof, or a chemically inert product contact layer e.g. of PET, or a norbornene ethylene copolymer or derivative thereof;

(b) an oxygen barrier layer;

(c) a water vapor barrier layer;

wherein the container film has the following properties:

(i) an oxygen transmission rate ($O_2$TR) of less than 10 cm$^3$/100 inches$^2$/24 hours at 1 atmosphere and 23° C. and 0% R.H.; and (ii) (ii) a water vapor transmission rate (WVTR) of less than 0.5 g/100 inches$^2$ per 24 hours at 100° F. (38° C.), 90% R.H. and 1 atmosphere; and (iii) a thickness of 5 mil or less.

Other examples of film structures for pouches include the following:

LLDPE monolayer; EVA monolayer, HDPE monolayer; PE/EVA/tie/EVOH/tie/EVA; PE/EVA/tie/EVOH/tie/EVA/PE; ionomer/tie/EVOH/tie/ionomer; EVA/tie/EVOH/tie/EVA/tie/EVOH/tie/EVA; EVA/PE/COC/tie/COC/PE/EVA; EAO/tie/EVOH/tie/EVA/tie/EVOH/tie/EAO; PET/PE; PET/tie/polyolefin.

An example of commercially available ethylene vinyl acetate copolymer (EVA) includes Elvax® 3135XZ EVA having a reported vinyl acetate (VA) content of 12%, a density of 0.930 g/cm$^3$, a melt index of 0.35 g/10 min and a melting point of 95° C., which is supplied by E. I. du Pont de Nemours and Company, Wilmington, Del., U.S.A.

The exterior, intermediate or tie layers of the bag film may be formed of any suitable plastic materials, for example, polyolefins, and in particular members of the polyethylene family such as LLDPE, VLDPE, HDPE, LDPE, ethylene vinyl ester copolymer or ethylene alkyl acrylate copolymer, polypropylenes, ethylene-propylene copolymers, ionomers, polybutylenes, alpha-olefin polymers, polyamides, nylons, polystyrenes, styrenic copolymers (e.g. styrene-butadiene copolymer), polyesters, polyurethanes, polyacrylamides, anhydride-modified polymers, acrylate-modified polymers, polylactic acid polymers, cyclic olefin copolymers, or various blends of two or more of these materials. It may also include paper, metal or foil layers.

Methods of Manufacture

Unless otherwise noted, the thermoplastic resins utilized are generally commercially available in pellet form and, as generally recognized in the art, may be melt-blended or mechanically mixed by well-known methods using commercially available equipment including tumblers, mixers or blenders. Also, if desired, well-known additives such as processing aids, slip agents, anti-blocking agents and pigments, and mixtures thereof may be incorporated into the film or applied to one or more surfaces thereof, e.g. by blending prior to extrusion, powdering, spraying, contact roller application, etc. Typically the resins and any desired additives are mixed and introduced to an extruder where the resins are melt plastified by heating and then transferred to an extrusion (or coextrusion) die. Extruder and die temperatures will generally depend upon the particular resin or resin containing mixtures being processed and suitable temperature ranges for commercially available resins are generally known in the art or are provided in technical bulletins made available by resin manufacturers. Processing temperatures may vary depending upon other processing parameters chosen. The films described in the present application may be fabricated by any coextrusion method known to a person of ordinary skill in the art. A suitable wall packaging film may be manufactured by the following steps: (a) adding thermoplastic resins to extruders for extrusion into a multilayer film; (b) heating the thermoplastic resins to form streams of melt-plastified polymers; (c) forcing the streams of melt-plastified polymers through a multi-orifice annular blown film die to form a tubular extrudate having a diameter and a hollow interior; (d) expanding the diameter of the tubular extrudate by a volume of gas entering the hollow interior via the central orifice; and (e) collapsing the expanded blown film tubular extrudate onto itself using heated nip rollers to form the final film structure. Notwithstanding the above, the multilayer package film may be made by any conventional processes. These processes may include, e.g., cast or blown film processes, coating lamination, adhesive lamination and conventional forming, sealing and/or cutting operations Stay Construction In the present application, a rigid deformable resilient stay is described. This stay is attached to a package wall portion. The stay has sufficient resiliency and stiffness to permit compressive flexing to create a package opening with nothing more than hand pressure and yet springs back to its original configuration and dimensions upon release of hand pressure. Thus, stays may be designed to have a resiliency sufficient to spring back to an original planar form upon removal of pinching forces with each stay in parallel abutting alignment with sufficient dimensional integrity to close the package.

The terms "stay" and "rigid member" are used interchangeably. The stays be polymeric, but metal stays may also be functional.

Suitable stays in paired use as part of the closure for the package described in the present application upon application of compressive or pinching forces create a package opening which may be lens-shaped or oval-shaped or the like.

Stay Thickness

A stay may have a total thickness of at least about 8 mil (203 micron) or a total thickness of from about 10 to 20 mil (254-508 microns (μ)). In one embodiment, the stay thickness will be uniform across its length and especially across its central portion between the stay ends. Some embodiments may have a thickness from about 12 to 18 mil. For example, stays may be cut from a sheet of any suitable thickness, including 8, 9, 10, 11, 12, 13, 14, 15, or 20 mil, or any increment of 0.1 or 0.01 mil therebetween. Although suitable stay thicknesses for making the closure, as thick as 30 mil (762 micron) or higher, or as thin as 8 mil (203 micron) or less may be made, the most common stay thicknesses may be between about 12-18 mil (305-457 micron). Such stays may have excellent resiliency, high stiffness, good machinability and suitability for hand compression and spring back. Stays over 20 mil in thickness may have too much stiffness and be more difficult for compression opening by children, the elderly or people with lesser than average hand strength, although choice of materials will impact this design decision. Thus, thicker stays may be heavier than necessary for most applications and may be more expensive from a material cost standpoint.

Stay Layers

The stay may be a monolayer or a multilayer construction. Stay sheets of 1, 2, 3, 4, 5 or more layers are contemplated for the stay construction. For most products, a monolayer sheet, e.g. of a polyester such as APET, may be used with or without the addition of surface coating layers of a suitable adhesive or sealant polymer for attachment to the wall portion film and cover film.

In other embodiments, the stay may comprise or consist essentially of at least one layer of a PVC. PP, polyethylene, polystyrene, e.g., high impact polystyrene, or nylon or polyamide composition. In all embodiments, the stay material has a suitable stiffness and resiliency which may be determined without undue experimentation.

In one embodiment, the stay comprises at least one polyester polymer. Non-limiting examples of polyester polymers include aliphatic polyesters and aromatic polyesters, such as homopolymers or copolymers of polyethylene terephthalate (PET), polyethylene naphthalate and blends thereof. Polyester materials may be derived from dicarboxylic acid components, including terephthalic acid and isophthalic acid and also dimers of unsaturated aliphatic acids. Examples of a diol component as another component for synthesizing the polyester may include polyalkylene glycols, such as ethylene glycol, propylene glycol, tetramethylene glycol, neopentyl glycol, hexamethylene glycol, diethylene glycol, polyethylene glycol and polytetra methylene oxide glycol; 1,4-cyclohexane-dimethanol; and 2-alkyl-1,3-propanediol. More specifically, examples of dicarboxylic acids constituting the polyester resin may include terephthalic acid, isophthalic acid, phthalic acid, 5-t-butylisophthalic acid, naphthalene dicarboxylic acid, diphenyl ether dicarboxylic acid, cyclohexane-dicarboxylic acid, adipic acid, oxalic acid, malonic acid, succinic acid, azelaic acid, sebacic acid, and dimer acids comprising dimers of unsaturated fatty acids. These acids may be used singly or in combination of two or more species. Examples of diols constituting the polyester resin may include ethylene glycol, propylene glycol, tetramethylene glycol, neopentyl glycol, hexamethylene glycol, diethylene glycol, polyalkylene glycol, 1,4-cyclohexane-dimethanol, 1,4-butanediol, and 2-alkyl-1,3-propane diol. These diols may be used singly or in combination of two or more species.

Polyester compositions that comprise an aromatic polyester resin comprising an aromatic dicarboxylic acid component may be used. Such compositions include, e.g., polyesters between terephthalic acid (as a dicarboxylic acid) and diols having at most 10 carbon atoms, such as polyethylene terephthalate and polybutylene terephthalate. Particular examples thereof may include copolyesters obtained by replacing a portion, e.g., at most 30 mol % or at most 15 mol % of the terephthalic acid with another dicarboxylic acid, such as isophthalic acid; copolyesters obtained by replacing a portion of the diol component such as ethylene glycol with another diol, such as 1,4-cyclohexane-dimethanol (e.g., "Voridian 9921", made by Voridian division of Eastman Chemical Co.); and polyester-polyether copolymers comprising the polyester as a predominant component (e.g., polyester-ether between a dicarboxylic acid component principally comprising terephthalic acid or/and its ester derivative and a diol component principally comprising tetramethylene glycol and tetramethylene oxide glycol, e.g., containing the polytetra methylene oxide glycol residue in a proportion of 10-15 weight %). It is also possible to use two or more different polyester resins in mixture. Examples of polyesters are available under the trademarks Voridian 9663, Voridian 9921 and EASTAR® Copolyester 6763, all from Eastman Chemical Company, Kingsport, Tenn., U.S.A.

The stay may be attached to the interior surface of the package wall film. This attachment may be made proximate to one end of the pouch to provide ease of removal of the least amount of material for initial opening and simultaneously provide for the greatest product holding area per unit size of film materials used. The closure may divide the package into a first product containing area and a second removable end portion to provide an initial opening area separated from the product holding area. It will be recognized, however, that the present application contemplates that the stays may be placed at an angle on the package, e.g., extending from a point on the top between the opposing sides and angled downward to a point on one side. In this fashion, the package may accommodate a closure on a package of larger width than a typical hand would otherwise permit, since the pinching action by one hand may require a dimension which may be less than 5 inches for a normal-sized adult hand. In some embodiments, the closure flat width may be from about 2 to 4 inches. By placement of this at an angle, a larger package may be made but the weight and stiffness of the package walls are considerations to prevent undesirable folding of the package body during one-handed operation. Such angled attachment may be better suited for two-handed operation, where a second hand may be used to support the weight of the package during pouring while the other hand may operate the self-shutting closure.

Cover Film Construction

The cover film used in the package described in the present application may be any type of monolayer or multilayer film adequate to form efficacious rolled edges and to be attached to the wall film. For example, non-shrink films useful for making the wall film may be used. The cover film may also be a heat shrinkable film. Each cover film may be monolayer or may have 1, 2, 3, 4, 5, 6, 7 or more layers.

A heat shrinkable film has the property of shrinking greatly in (and having shrink forces applied in) a uniaxial or longitudinal or machine direction or in a transverse direction or in multi-axial, e.g. biaxial, directions. Such shrink films are well known in the art of making heat shrinkable, axially-oriented films and may be made by a variety of methods including MDO, tenter frames, double bubble or trapped bubble stretch orientation processes such as those disclosed in U.S. Pat. Nos. 3,022,543; 3,456,044; 4,277,594; 5,076,977; and as disclosed in "Films, Orientation", Encyclopedia of Polymer Science and Technology, 3rd Ed., pp. 559-577, (2003, John Wiley & Sons, Hoboken, N.J., USA). Commercially available heat shrinkable films are manufactured by many companies including Bemis North America in Oshkosh, Wis., USA and Bemis Europe in Valkeakoski, Finland.

Heat shrinkable films may be axially-oriented with preferential orientation in the direction receiving the most stretch during film formation. The resulting film shrinks preferentially in the same direction that was stretched more during film manufacture. Machine direction (MD) is along the direction of film transport during or after extrusion. Transverse direction (TD) is perpendicular to the direction of film transport. Shrinkage is preferentially machine direction orientation (MD) if more stretch is applied to the MD than to the TD and TD if more stretch is applied transverse than machine direction.

Films have an MD or TD ratio (ratio of oriented stretch length to the unstretched length in the MD or TD direction, respectively). For this present application, this ratio may be at least 1.5:1 or at least 2:1 or at least 3:1, or between about 2:1 to 5:1. Uniaxially stretched films may be employed, especially. e.g., those films stretched in the machine direction. There is no clear upper limit for the orientation ratio, although films typically have a ratio of 10:1 or less.

The shrink films used for package described in the present application may have a heat shrinkability (e.g. at 90° C.) of at least 10%, 20%, 30%, or higher in at least one direction. In some embodiments, the shrinkability is disproportionate in one direction and advantageously a uniaxial shrink of 10, 15, 20, 25, 30 percent or higher may be used and may be couple with a cross-directional shrink value that is less than 10% or less than 5% or less than 3% or even 0%, or may even slightly expand in the cross-directional dimension, e.g. up to 5% or from 0 to 3%.

The shrink films may have a maximum shrink force in the machine direction greater than 50 grams at 90° C. and in the transverse direction less than that for the machine direction and, in some embodiments, less than 50 grams at 90° C. In some embodiments, a shrink temperature in the range of between about 70-110° C. may induce the maximum force for heat shrinkable cover films. In other embodiments, films having maximum shrink forces in a range of 250 to 1,100 grams force at about 200° C. or 400 to 1000 grams force at about 200° C. or 800 to 1000 grams force at about 200° C. may be used. Maximum shrink forces may be useful to pull typical wall film around the stay edge to form a rolled edge.

Many of the same thermoplastic polymeric materials identified for packaging body wall construction may be used for constructing the cover film. In some embodiments, the resins are selected for their ability to be stretch orientated by machine direction cast orientation (MDO), tenter frame, double bubble or trapped bubble or processes, as further described above. In such embodiments, typically employed resins for use in making the heat shrinkable films of the prior art may also be used. For example, each cover film may have at least one layer of a homopolymer or copolymer of ethylene, a homopolymer or copolymer of polypropylene, or layers or mixtures thereof. Further non-limiting examples include polyolefins, e.g. ethylene polymers and copolymers, cyclic polyolefins and styrenic copolymers. The structure of a heat shrinkable cover film is generally dictated by its ability to supply the forces needed to produce rolled edges and, therefore, either monolayer or multilayer films may be used.

A pair of first and second cover films are designed to closely abut one another, thereby sealing the closure sufficiently to retain hand held package contents, e.g., contents having a weight of less than 500 grams or less than 300 grams or less than 100 grams from inverted spillage under force of gravity.

Packages, Properties and Test Methods

Reported properties for the bags, stays and films described in the present application are based on the following test methods or substantially similar test methods unless noted otherwise:

Oxygen Gas Transmission Rate ($O_2$GTR): ASTM D-3985-81

Water Vapor Transmission Rate (WVTR): ASTM F 1249-90

Gauge: ASTM D-2103

Melt Index (M.I.): ASTM D-1238, Condition E (190° C.) (except for propene-based (>50% $C_3$ content) polymers tested at Condition TL (230° C.))

Melting point (m.p.): ASTM D-3418, DSC with 5° C./min heating rate

Glass transition temperature ($T_g$): ASTM D3418

Gloss: ASTM D-2457, 60° angle

Haze: ASTM 0-1003

Puncture: ASTM F-1306

Stiffness: ASTM D-6125-97 or TAPPI # T543

Shrinkage Values: Shrinkage values are defined to be values obtained by measuring unrestrained (or free) shrink of a 10 cm square sample immersed in water at 90° C. (or the indicated temperature if different) for five seconds. Four test specimens are cut from a given sample of the film to be tested. The specimens are cut into squares of 10 cm length in the machine direction by 10 cm length in the transverse direction. Each specimen is completely immersed for 5 seconds in a 90° C. (or the indicated temperature f different) water bath. The specimen is then removed from the bath and the distance between the ends of the shrunken specimen is measured for both the machine (MD) and transverse (TD) directions. The difference in the measured distance for the shrunken specimen and the original 10 cm side is multiplied by ten to obtain the percent of shrinkage for the specimen in each direction. The shrinkage of four specimens is averaged for the MO shrinkage value of the given film sample, and the shrinkage for the four specimens is averaged for the TD shrinkage value. Shrinkage values may also be defined as having a percentage shrink at a temperature "T" (e.g. between 80-150° C., (such as 90° C. in certain embodiments)) of from 0 to "A" in at least one axial direction which in use corresponds to the cover film's longitudinal stay dimension (length). The other direction (height) of a heat shrink cover film may have a minimum percentage shrink (B) at a specified temperature e.g. from about 80 to about 150° C., (such as 90° C. in certain embodiments). In some embodiments, "A" is from 0 to 30, and B≥A. In such embodiments, A may be less than 10% or less than 5% and B may be greater than 15% or at least 20% or higher.

As a non-limiting example of shrinkage values, in some embodiments, the packaging wall will have less than 5% shrink at 90° C. in both MD and TD or less than 3% or 0%. In some embodiments, the cover film will have at least 10% shrink in one direction and suitably at least 15, 20, 25, 30% or higher in the machine direction, and the cover film will be disposed so that this direction of greater shrink will run perpendicular to the closure opening, i.e., with the direction extending from an attachment line to a proximate stay edge. In some embodiments, the cover film will also have less than 15, 10, 5 or 3% shrink in the other direction.

The temperature selected for the parameter in the above description may be selected with consideration of the materials chosen for the package wall, stays, and cover film. For example, polyolefins such as polyethylene and polypropylene, as homopolymers and copolymers, melt (and also have glass transition temperatures and softening points) over a range of temperatures. These temperature ranges may differ from polymer to polymer and from polymer family to polymer family.

Shrink Force: As used throughout this application, the term "shrink force" refers to the force or stress exerted by the film on the package as the film contracts under heat. The shrink force of a film is equal to that force or stress required to prevent shrinkage of the film under specified conditions. A value representative of the shrink force may be obtained using an Instron Tensile tester with a heated chamber. The position was held constant, and the temperature was ramped up. The Instron software was used to collect force versus time data. The temperature/time was manually recorded throughout each run and time data converted to temperature. Six replicates were collected using the following run conditions:

1" wide strips; 4" jaw span held constant throughout test

Caliper measured and entered into program.

Sample loaded with minimal force at 25° C.

Temperature controller was set to 400° C. to ramp the temperature up quickly.

Test time/speed was set to 5 minutes at 0 mm/min.

Instron software recorded Force vs Time.

Operator manually recorded Force, Time and Temp in 5° C. increments.

Test was started and temperature was ramped up as soon as the door was closed.

Data collection speed was 100 ms per data point.

The shrink force for the film sample is reported in Newtons. The shrink force may be determined by cutting out rectangular specimens from the sample films with the long axis parallel to either the machine or transverse direction. The specimens are clamped at the short ends so that the force to be measured is applied along the long axis. One clamp is stationary, while the other clamps are housed in a small oven whose heating rate can be accurately controlled. The specimen is heated and the force needed to hold the movable clamp at a fixed distance from the stationary clamp is measured. This force is equal to and opposite the shrink force.

Pinching/Compression Force: The pinching/compression force is equal to the force or stress required to push together first and second sides edges of a package in the area of the closure to cause central portions of each stay (and the corresponding package wall portions and cover film portions) to bow apart outward from each other, causing the closure to create an opening in the package. As described above, such opening may be lens-shaped or oval-shaped or the like. The combined movement of the side edges (i.e., the "pushing together") is equivalent to one-inch. For example, the first side edge may move one-inch toward the second side edge, while the second side edge remains stationary; the second side edge may move one-inch toward the first side edge, while the first side edge remains stationary; or each of the first side edge and the second side edge may move 0.5 inch, for a combined movement of one-inch.

Pinching/compression force values are measured using an Instron Tensile tester. A package is clamped to the upper jaw and the lower jaw of the Instron at each side edge in the area of the closure. The upper jaw of the Instron moves downward at a rate of four inches per minute to an extension of one-inch. The force in grams needed to open the closure is recorded at various time intervals (e.g., over about a 15 second time span, equivalent to a one-inch extension/movement of the upper jaw of the Instron).

Physical properties were measured for some suitable materials useful as bag wall films or stays and are reported in Table 1 below:

TABLE 1

| | Structure | Gauge mil | Haze % | Gloss at 60° | Gurley stiffness mg force MD/TD | Puncture Resistance lbs force |
|---|---|---|---|---|---|---|
| 1 | Flexible SUP film | 4.35 | ND | 101 | 70/87 | 2.3 |
| 2 | VLDPE:LLDPE/LLDPE:EVA/tie/EVOH/tie/VLDPE:EVA/mEAO:LDPE film | 2.5 | 13 | 85 | 5/6 | 2.0 |
| 3 | mEAO/tie/PA/EVOH/PA/tie/EVA/tie/PA/EVOH/PA/tie/mEAO film | 3.5 | 24 | 75 | 10/11 | 4.1 |
| 4 | APET sheet | 14 | 3 | 143 | 3,627/3,588 | ND |

TABLE 1-continued

| | Structure | Gauge mil | Haze % | Gloss at 60° | Gurley stiffness mg force MD/TD | Puncture Resistance lbs force |
|---|---|---|---|---|---|---|
| 5 | PVC sheet | 14 | 7 | 141 | 3,289/3,058 | ND |
| 6 | High Clarity PP sheet | 14 | 11 | 135 | 2,720/2,676 | ND |
| 7 | sealant/APET sheet/sealant | 15.1 | 8 | ND | ND | ND |

ND = Not Determined

The above films in Structures 1-3 have suitable puncture resistance values and optical properties for use as packaging wall films. The stiffness values are also indicative and typical of those found in flexible bag materials. The above sheets in Structures 4-7 have suitable stiffness values for use as stay materials. Stays may be cut to size from these sheets.

Physical properties were measured for some cover film materials and are reported in Table 2 below:

TABLE 2

| | Structure | Gauge mil | Shrink % at 90° C. MD/TD | Maximum Shrink Force: Force grams MD/TD | Maximum Shrink Force: Temperature ° C. MD/TD |
|---|---|---|---|---|---|
| 8 | MDPE/LLDPE:LDPE:HDPE/MDPE film | 1.25 | ND/ND | 30/24 | 25/24 |
| 9 | MDPE:LLDPE/LLDPE:LDPE:HDPE/ MDPE:LLDPE film | 2.5 | ND/ND | 21/29 | 23/116 |
| 10 | mLLDPE/PA/EVOH/PA/EVA/PA/EVOH/PA/ mLLDPE (unstretched) | 5.25 | 0/0 | 11/ND | 147/ND |
| 11 | mLLDPE/tie/PA/EVOH/PA/tie/mLLDPE film | 2.75 | ND/ND | 889/37 | 96/24 |
| 12 | plastomer:VLDPE:ionomer/ VLDPE:plastomer/plastomer:VLDPE:ionomer | 5.25 | 45/49 | 1068/874 | 190/163 |
| 13 | mLLDPE/PA/EVOH/PA/EVA/PA/EVOH/PA/ mLLDPE (2:1 stretch ratio) | 2.75 | 20/0 | 960/ND | 204/ND |
| 14 | mLLDPE/PA/EVOH/PA/EVA/PA/EVOH/PA/ mLLDPE (4:1 stretch ratio | 1.5 | 15/0 | 993/ND | 206/ND |
| 15 | PP copolymer:PP homopolymer/PP copolymer:PP homopolymer/PP copolymer:PP homopolymer (2:1 stretch ratio) | 1.75 | 21/−4 | 300/ND | 201/ND |
| 16 | PP copolymer:PP homopolymer/PP copolymer:PP homopolymer/PP copolymer:PP homopolymer (4:1 stretch ratio) | 0.75 | 16/0 | 282/ND | 204/ND |

Structures 8, 9 and 10 have inadequate shrink force to produce a rolled edge through shrink properties, whereas Structures 11-16 have sufficient shrink force to produce the required rolled edge. Structures 8, 9 and 10 might be used as cover films in an alternative embodiment where the rolled edges are produce manually or mechanically with heat sealing and/or an adhesive to maintain the edge. In such an alternative embodiment, no shrink is involved, and the cover film is held taut and sealed to ensure proper closing.

Pinching/compression forces were measured for the self-shutting, manually re-openable packages of Example 2 and Example 3 (as described above). (NB: Example 2 and Example 3 are not to be confused with Structure 2 and Structure 3). For a one-inch movement for Example 2, forces ranged from 86.8 grams force to 866.3 grams force, with an average of 673.7 grams force. For a one-inch movement for Example 3, forces ranged from 136.8 grams force to 1268.1 grams force with an average of 804.6 grams forces. The self-closing manually re-openable package described in the present application may have an average pinching force over one-inch movement of from 500 grams force to 1,100 grams force or from 550 grams force to 950 grams force or from 600 grams force to 850 grams force.

The above described self-closing re-openable container in accordance with the present application may be used to package a wide variety of small pourable solid articles of, e.g., Ingestible items such as a plurality of seeds, edible nuts, chocolates, jelly beans, candies, confections, mints, raisins, dried fruit, granola, cereal, grain, chewing gum, snacks, edible decorations, human food, pet food (e.g. fish food flakes, birdseed, dog treats), vitamins, nutritional supplements, cough drops, or medicine, or a plurality of such industrial or consumer items as fasteners, screws, hooks, snaps, paper dips, BB shot, beads, decorative objects, toothpicks, adhesive tabs, game pieces, buttons, or parts made of wood, metal, glass, ceramic, polymer or plastic. These small pourable solid articles may have an individual article volume of less than 5 $cm^3$.

Embodiments of the Application

1. A re-closable package comprising:

(a) a package body adapted for enclosing an article, said body having opposing top and bottom edges and a body wall disposed therebetween, said body wall having a first surface defining a package interior and an opposing second surface defining a package exterior, said body wall having a first body wall portion and a second body wall portion integrally connected to each other at opposing first and second side edges; and (b) a closure connected to said package body, said closure comprising:

(i) a first resilient, manually deformable stay having a central portion between first and second opposing stay ends:

(ii) a second resilient, manually deformable stay having a central portion between first and second opposing stay ends:

(iii) a first polymeric plastic cover film overlaying said first stay;

(iv) a second polymeric plastic cover film overlaying said second stay; and wherein each of said first and second stays has spaced apart, first and second longitudinal stay edges and each stay is disposed within said package interior with said first stay being disposed on said first body wall portion and said second stay being disposed on said second body wall portion opposite said first stay and in overlaying alignment, with each stay's first stay end being proximate said first side edge of said body wall and each stay's second stay end being proximate said second side edge of said body wall; and wherein said first and second cover films are attached to said first body wall surface at said first and second body wall portions respectively, each of said films being attached to said first body wall surface along opposing spaced apart, first and second longitudinal attachment lines, said lines being disposed in a direction corresponding to and in alignment with respective first and second longitudinal stay edges to provide at least one longitudinal unsealed gap area between at least one attachment line and a proximate stay edge and wherein each of said first and second cover films is attached to said body wall first surface whereby at least one longitudinal portion of said first body wall portion is transversely bent across said gap area and at least one longitudinal portion of said second body wall portion is transversely bent across said corresponding gap area thereby establishing a pair of opposing rolled edges.

2. A package, as defined in embodiments 1, 3-30, wherein at least one of said stays has a Gurley stiffness force of at least 1000 mg in both MD and TD.

3. A package, as defined in embodiments 1-2, 4-30, wherein at least one of said stays has a Gurley stiffness force from 1000 to 8000 mg in both MD and TD.

4. A package, as defined in embodiments 1-3, 5-30, wherein at least one of said stays has a thickness of at least 8 mil (203 micron), and in some embodiments, at least 12 mil.

5. A package, as defined in embodiments 1-4, 6-30, wherein each of said stays has a thickness of from 8 to 20 mil (203 to 508 micron).

6. A package, as defined in embodiments 1-5, 7-30, wherein said first and second cover films are fastened by heat sealing to an interior surface of said package body wall.

7. A package, as defined in embodiments 1-6, 8-30, wherein at least one of said first and second stays is heat sealed to respective opposing portions of said first body wall surface.

8. A package, as defined in embodiments 1-7, 9-30, wherein said first and second stays are each held by entrapment within a space defined by a spaced apart attachment of said body wall and said first and second cover films respectively.

9. A package, as defined in embodiments 1-8, 10-30, wherein at least one of said stays is attached to said first body wall by adhesive.

10. A package, as defined in embodiments 1-9, 11-30, wherein each of said stays has at least one layer comprising a homopolymer or copolymer of polyester, polypropylene, polyethylene, polyamide, polystyrene, polyvinyl chloride, or mixtures thereof.

11. A package, as defined in embodiments 1-10, 12-30, wherein at least one of said stays has at least one to seven layers.

12. A package, as defined in embodiments 1-11, 13-30, wherein at least one of said unsealed gap areas has a distance along said first wall body surface between said attachment line and said proximate stay edge of from 0.0625 to 0.3125 inch (1.59 to 7.94 millimeters).

13. A package, as defined in embodiments 1-12, 14-30, wherein said at least one of said unsealed gap areas has a distance along said first wall body surface between said attachment line and said proximate stay edge of from 0.1875 to 0.25 inch (4.76 to 6.35 millimeters).

14. A package, as defined in embodiments 1-13, 15-30, wherein said package body wall is substantially non-shrinkable having a shrinkage value of less than 5% at 90° C. in at least one or both of MD and TD.

15. A package, as defined in embodiments 1-14, 17, 18, 21-30, wherein both of said cover films is substantially non-shrinkable having a heat shrinkage value of less than 5% at 90° C. in at least one or both of MD and TD.

16. A package, as defined in embodiments 1-14, 17-30, wherein each of said first and second cover films is a shrink film having a shrinkage value in at least one direction of at least 10% at 90° C. with said direction extending from said attachment line to said proximate stay edge.

17. A package, as defined in embodiments 1-16, 18-30, wherein each of said first and second cover films has a shrinkage force value in at least one direction of less than 50 grams at 90° C. with said direction extending (a) from said attachment line to said proximate stay edge or (b) perpendicular thereto.

18. A package, as defined in embodiments 1-17, 19-30, wherein each of said first and second cover films has a shrinkage force value in at least one direction of less than 50 grams at 90° C. with said direction extending perpendicular to a line drawn from said attachment line to said proximate stay edge.

19. A package, as defined in embodiments 1-18, 20-30, wherein each of said first and second cover films has a shrinkage force value in at least one direction of at least 50 grams at 90° C. with said direction extending from said attachment line to said proximate stay edge.

20. A package, as defined in embodiments 1-19, 21-30, wherein each of said first and second cover films has a shrinkage force value in at least one direction of from 250 grams to 1,100 grams at 200° C. with said direction extending from said attachment line to said proximate stay edge.

21. A package, as defined in embodiments 1-20, 22-30, wherein each of said first and second cover films has at least 1-7 layers.

22. A package, as defined in embodiments 1-21, 23-30, wherein each of said first and second cover films has at least one layer comprising a homopolymer or copolymer of ethylene, a homopolymer or copolymer of propylene, or mixtures thereof.

23. A package, as defined in embodiments 1-22, 24-30, wherein said package body wall has at least one layer comprising a homopolymer or copolymer of polyester, polypropylene, polyethylene, polyamide, a cyclic olefin copolymer, polystyrene, paper, foil, metal or mixtures thereof.

24. A package, as defined in embodiments 1-23, 25-30, wherein said package has within said package body a first product containing area and a second removable end portion area, said first and second package body areas being separated by said closure.

25. A package, as defined in embodiments 1-24, 26-30, wherein said package further comprises a plurality of small pourable solid articles having an individual article volume of less than 5 $cm^3$.

26. A package, as defined in embodiments 1-25, 27-30, wherein said package further comprises a plurality of small pourable solid articles of seeds, edible nuts, chocolates, jelly beans, candies, confections, mints, raisins, dried fruit, granola, cereal, grain, chewing gum, snacks, edible decorations, human food, pet food (e.g. fish food flakes, birdseed, dog treats), vitamins, nutritional supplements, cough drops, or medicine.

27. A package, as defined in embodiments 1-26, 28-30, wherein said package further comprises a plurality of small pourable solid articles of fasteners, screws, hooks, snaps, paper clips, BB shot, beads, decorative objects, toothpicks, adhesive tabs, game pieces, buttons, or parts made of wood, metal, glass, ceramic, polymer or plastic.

28. A package, as defined in embodiments 1-27, 29-30, wherein said stays have a resiliency sufficient to spring back to an elongate form upon removal of pinching forces with each stay in parallel abutting alignment with sufficient dimensional integrity to close said package.

29. A package, as defined in embodiments 1-28, 30, wherein said package has a manual pinch opening resistance between 500 grams to 1.100 grams or wherein said first and second cover films closely abut one another thereby sealing said closure sufficiently to retain package contents having a weight of less than 500 grams or less than 300 grams or less than 100 grams from inverted spillage under force of gravity.

30. A package, as defined in embodiments 1-29, wherein each of said first and second stays has two spaced apart longitudinal unsealed gap areas, with one gap area adjacent to said first stay edge and a second gap area adjacent to said second stay edge of each respective stay.

31. A package forming article comprising:

(a) a package body wall having a first body wall portion with opposing first and second side edges and a body wall disposed therebetween, said body wall having a first interior surface and an opposing second exterior surface; and (b) a first closure forming component having:

(i) a resilient, deformable stay having spaced apart, first and second longitudinal stay edges, said first and second stay edges running substantially parallel to and between said package body wall first and second side edges on said first interior surface of said wall with a first surface of said stay proximate said wall and a second stay surface opposite said first stay surface and distal from said wall;

(ii) a polymeric plastic heat shrink cover film overlaying said stay;

said shrink cover film being attached to said first body wall surface along opposing spaced apart, first and second longitudinal attachment lines said lines being disposed longitudinally to provide at least one longitudinal unsealed gap area between at least one attachment line and a proximate stay edge whereby said heat shrink cover film is adapted for heat activation to shrink and bend a longitudinal portion of said body wall across said gap area.

32. A package forming article, as defined in embodiments 31, 33-36, wherein said at least one gap area comprises a first gap area and a second gap area, and said shrink cover film forms said first gap area proximate said first stay edge and said second gap area proximate said second stay edge.

33. A package forming article, as defined in embodiments 31-32, 34-36, wherein said shrink cover film is not attached to said second stay surface and said first stay surface is attached to said first body wall surface.

34. A package forming article, as defined in embodiments 31-33, 35-36, wherein said stay comprises a plurality of spaced apart stays positioned end to end longitudinally.

35. A package forming article, as defined in embodiments 31-34, 36, further comprising a second package body wall portion and second closure component of similar structure as said first wall portion and first closure component, said second wall portion and second closure component positioned longitudinally with a first wall body wall surface of each of said first and second wall portions facing and adjacent to each other and said first and second closure components in alignment and overlaying each other; and wherein a longitudinal seal connects said first and second body wall portions proximate a first side edge of said respective body wall portions; and further comprising a plurality of spaced apart transverse seals extending from said first longitudinal seal to respective second longitudinal side edges of said first and second wall portions thereby forming a plurality of connected pouches each having an open bottom adapted for product filling adjacent to said second longitudinal side edges and hermetic sealing.

36. A package forming article, as defined in embodiment 35, wherein said transverse seals each has a center cut line for separating adjacent pouches and dividing each transverse seal into two abutting parallel transverse seals.

37. A package as defined in embodiments 1-30, made from a package forming article, as defined in embodiments 31-36.

Each and every document cited in this present application, including any cross-referenced or related patent or application, is incorporated in this present application in its entirety by this reference, unless expressly excluded or otherwise limited. The citation of any document is not an admission that it is prior art with respect to any embodiment disclosed or claimed in this present application or that it alone, or in any combination with any other reference or references, teaches, suggests or discloses any such embodiment. Further, to the extent that any meaning or definition of a term in this present application conflicts with any meaning or definition of the same term in a document incorporated by reference, the meaning or definition assigned to that term in this present application governs.

The above description, examples and embodiments disclosed are illustrative only and should not be interpreted as limiting. The present invention includes the description, examples and embodiments disclosed; but it is not limited to such description, examples or embodiments. Modifications and other embodiments will be apparent to a person of ordinary skill in the packaging arts, and all such modifications and other embodiments are intended and deemed to be within the scope of the present invention as described in the claims.

What is claimed is as follows:

1. A re-closable package comprising:

(a) a package body having opposing top and bottom edges and a body wall disposed between the top and bottom edges, the body wall having a first body wall portion and a second body wall portion integrally connected to each other at opposing first and second package body side edges; and (b) a closure connected to the package body, the closure comprising:

(i) a first stay having a first stay first longitudinal edge and an opposing first stay second longitudinal edge;

(ii) a second stay having a second stay first longitudinal edge and an opposing second stay second longitudinal edge;

(iii) a first cover film overlaying the first stay;

(iv) a second cover film overlaying the second stay;

wherein the first stay is disposed on the first body wall portion and the second stay is disposed on the second body wall portion opposite the first stay and in overlaying alignment;

wherein the first cover film is attached to the first body wall portion along a first cover film first longitudinal attachment line in a direction corresponding to and in alignment with the first stay first longitudinal stay edge and along a first cover film second longitudinal attachment line in a direction corresponding to and in alignment with the first stay second longitudinal stay edge, wherein at least one first cover film longitudinal unsealed gap area is provided; and the second cover film is attached to the second body wall portion along a second cover film first longitudinal attachment line in a direction corresponding to and in alignment with the second stay first longitudinal stay edge and along a second cover film second longitudinal attachment line in a direction corresponding to and in alignment with the second stay second longitudinal stay edge, wherein at least one second cover film longitudinal unsealed gap area is provided;

wherein at least one longitudinal portion of the first body wall portion is transversely bent across the first cover film longitudinal unsealed gap area and at least one longitudinal portion of the second body wall portion is transversely bent across the second cover film longitudinal unsealed gap area; and wherein the body wall has a shrinkage value of less than 5% at 90° C. in both MD and TD.

2. A package, as defined in claim 1, wherein at least one of the first stay or the second stay has a Gurley stiffness force of at least 1000 mg in both MD and TD.

3. A package, as defined in claim 1, wherein at least one of the first stay or the second stay has a thickness of at least 8 mil (203 micron).

4. A package, as defined in claim 1, wherein the first cover film is fastened by heat sealing to an interior surface of the first body wall portion and the second cover film is fastened by heat sealing to an interior surface of the second body wall portion.

5. A package, as defined in claim 1, wherein the first stay is heat sealed to an interior surface of the first body wall portion and the second stay is heat sealed to an interior surface of the second body wall portion.

6. A package, as defined in claim 1, wherein the first stay is held by entrapment within a space defined by the first body wall portion and the first cover film and the second stay is held by entrapment within a space defined by the second body wall portion and the second cover film.

7. A package, as defined in claim 1, wherein the first stay is attached to an interior surface of the first body wall portion by adhesive and the second stay is attached to an interior surface of the second body wall portion by adhesive.

8. A package as defined in claim 1, wherein the first cover film is not attached to the first stay, the first stay is attached to an interior surface of the first body wall portion, the second cover film is not attached to the second stay, and the second stay is attached to an interior surface of the second body wall portion.

9. A package, as defined in claim 1, wherein at least one of the first stay or the second stay has at least one layer comprising a homopolymer or copolymer of polyester, polypropylene, polyethylene, polyamide, polystyrene, polyvinyl chloride, or mixtures thereof.

10. A package, as defined in claim 1, wherein at least one of the first cover film longitudinal unsealed gap area or the second cover film longitudinal unsealed gap area has a distance from the respective longitudinal attachment line to the respective longitudinal stay edge of from 0.0625 to 0.3125 inch (from 1.59 to 7.94 millimeter).

11. A package, as defined in claim 1, wherein each of the first cover film and the second cover film has a shrink force value in at least one direction of at least 50 grams at 90° C., with the direction extending from the respective longitudinal attachment line to the respective stay edge.

12. A package, as defined in claim 1, wherein each of the first cover film and the second cover film has a shrink force value in at least one direction of from 250 grams to 1,100 grams at 200° C., with the direction extending from the respective longitudinal attachment line to the respective stay edge.

13. A package, as defined in claim 1, wherein each of the first cover film and the second cover film has at least one layer comprising a homopolymer or copolymer of ethylene, a homopolymer or copolymer of propylene, or mixtures thereof.

14. A package, as defined in claim 1, wherein each of the first stay and the second stay has a resiliency sufficient to spring back to its original planar form upon removal of pinching force and wherein the first stay and the second stay are in parallel abutting alignment with sufficient dimensional integrity to close the package.

15. A package, as defined in claim 1, wherein the package has an average pinching force over one-inch movement of from 500 grams to 1,100 grams.

16. A package, as defined in claim 1, wherein a second first cover film longitudinal unsealed gap area is provided and a second cover film longitudinal unsealed gap area is provided.

17. A package, as defined in claim 1, wherein the first stay has a stay first edge and a stay second edge and the second stay has a stay first edge and a stay second edge and wherein each of the first stay first edge and second stay first edge is proximate the first package body side edge and each of the first stay second edge and second stay second edge is proximate the second package body side edge.

18. A re-closable package comprising:

(a) a package body having opposing top and bottom edges and a body wall disposed between the top and bottom edges, the body wall having a first body wall portion and a second body wall portion integrally connected to each other at opposing first and second package body side edges; and (b) a closure connected to the package body, the closure comprising:

(i) a first stay having a first stay first longitudinal edge and an opposing first stay second longitudinal edge;

(ii) a second stay having a second stay first longitudinal edge and an opposing second stay second longitudinal edge;

(iii) a first cover film overlaying the first stay;

(iv) a second cover film overlaying the second stay;

wherein the first stay is disposed on the first body wall portion and the second stay is disposed on the second body wall portion opposite the first stay and in overlaying alignment;

wherein the first cover film is attached to the first body wall portion along a first cover film first longitudinal attachment line in a direction corresponding to and in alignment with the first stay first longitudinal stay edge and along a first cover film second longitudinal attachment line in a direction corresponding to and in alignment with the first stay second longitudinal stay edge, wherein at least one first cover film longitudinal unsealed gap area is provided; and the second cover film is attached to the second body wall portion along a second cover film first longitudinal attachment line in a direction corresponding to and in alignment with the second stay first longitudinal stay edge and along a second cover film second longitudinal attachment line in a direction corresponding to and in alignment with the second stay second longitudinal stay edge, wherein at least one second cover film longitudinal unsealed gap area is provided; wherein at least one longitudinal portion of the first body wall portion is transversely bent across the first cover film longitudinal unsealed gap area and at least one longitudinal portion of the second body wall portion is transversely bent across the second cover film longitudinal unsealed gap area; and wherein each of the first cover film and the second cover film has a shrinkage value in at least one direction of at least 10% at 90° C., with the direction extending from the respective longitudinal attachment line to the respective stay edge.

19. A re-closable package comprising:

(a) a package body having opposing top and bottom edges and a body wall disposed between the top and bottom edges, the body wall having a first body wall portion and a second body wall portion integrally connected to each other at opposing first and second package body side edges; and (b) a closure connected to the package body, the closure comprising:

(i) a first stay having a first stay first longitudinal edge and an opposing first stay second longitudinal edge;

(ii) a second stay having a second stay first longitudinal edge and an opposing second stay second longitudinal edge;

(iii) a first cover film overlaying the first stay;

(iv) a second cover film overlaying the second stay;

wherein the first stay is disposed on the first body wall portion and the second stay is disposed on the second body wall portion opposite the first stay and in overlaying alignment;

wherein the first cover film is attached to the first body wall portion along a first cover film first longitudinal attachment line in a direction corresponding to and in alignment with the first stay first longitudinal stay edge and along a first cover film second longitudinal attachment line in a direction corresponding to and in alignment with the first stay second longitudinal stay edge, wherein at least one first cover film longitudinal unsealed gap area is provided; and the second cover film is attached to the second body wall portion along a second cover film first longitudinal attachment line in a direction corresponding to and in alignment with the second stay first longitudinal stay edge and along a second cover film second longitudinal attachment line in a direction corresponding to and in alignment with the second stay second longitudinal stay edge, wherein at least one second cover film longitudinal unsealed gap area is provided; wherein at least one longitudinal portion of the first body wall portion is transversely bent across the first cover film longitudinal unsealed gap area and at least one longitudinal portion of the second body wall portion is transversely bent across the second cover film longitudinal unsealed gap area; and wherein the first cover film is a heat shrink film adapted for heat activation to shrink and bend the first body wall portion across the first cover film longitudinal unsealed gap area and the second cover film is a heat shrink film adapted for heat activation to shrink and bend the second body wall portion across the second cover film longitudinal unsealed gap area.

* * * * *